US009220323B2

(12) United States Patent
Hamada et al.

(10) Patent No.: US 9,220,323 B2
(45) Date of Patent: Dec. 29, 2015

(54) SLIDER PROVIDED WITH HANDLE AT REAR FOR SLIDE FASTENER

(71) Applicant: YKK Corporation, Tokyo (JP)

(72) Inventors: Yoshikazu Hamada, Toyama (JP); Keiichi Keyaki, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 14/442,248

(22) PCT Filed: Nov. 12, 2012

(86) PCT No.: PCT/JP2012/079288

§ 371 (c)(1),
(2) Date: May 12, 2015

(87) PCT Pub. No.: WO2014/073111

PCT Pub. Date: May 15, 2014

(65) Prior Publication Data

US 2015/0335107 A1 Nov. 26, 2015

(51) Int. Cl.

| | |
|---|---|
| ***A44B 19/30*** | (2006.01) |
| ***A44B 19/26*** | (2006.01) |
| ***F16B 45/04*** | (2006.01) |

(52) U.S. Cl.

CPC ..... *A44B 19/262* (2013.01); *F16B 45/04* (2013.01)

(58) Field of Classification Search

CPC .... A44B 19/308; A44B 19/26; A44B 19/262; A44B 19/306; A44B 19/30; Y10T 24/2586; Y10T 24/2568; Y10T 24/2566; Y10T 24/2571; Y10T 24/2577

USPC ..... 24/424, 421, 429, 418, 419, 420, 422, 24/423, 430

See application file for complete search history.

(56) References Cited

U.S. PATENT DOCUMENTS 4,624,032 A * 11/1986 Ishii ..... A44B 19/26 24/419
4,780,938 A * 11/1988 Ishii ..... A44B 19/26 24/419

(Continued)

FOREIGN PATENT DOCUMENTS

| | | |
|---|---|---|
| JP | S53-36903 | 9/1951 |
| WO | 2010/058465 A1 | 5/2010 |
| WO | 2011/086703 A1 | 7/2011 |

OTHER PUBLICATIONS

International Search Report, PCT Application No. PCT/JP2012/079288, Jan. 22, 2013.

*Primary Examiner* — Robert J Sandy
*Assistant Examiner* — Rowland Do
(74) *Attorney, Agent, or Firm* — Kilpatrick Townsend & Stockton LLP

(57) ABSTRACT

There is provided a pull tab post-attaching slider for a slide fastener. An upper blade of a slider body includes a first mounting portion. A free end portion of a pull tab attachment rod includes a second mounting portion. A blocking member includes a first mounted portion mounted on the first mounting portion and a second mounted portion mounted on the second mounting portion. One of the first mounting portion and the first mounted portion includes a first dovetail groove portion and the other includes a first fitting engagement portion having a first fitting engagement structure fitted into the first dovetail groove portion. One of the second mounting portion and the second mounted portion includes a second dovetail groove portion and the other includes a second fitting engagement portion having a second fitting engagement structure fitted into the second dovetail groove portion.

10 Claims, 12 Drawing Sheets

(56) References Cited

U.S. PATENT DOCUMENTS 4,829,638 A * 5/1989 Ishii ..... A44B 19/26 24/419
5,068,950 A * 12/1991 Yuki ..... A44B 19/262 24/419
5,551,129 A * 9/1996 Chu ..... A44B 19/26 24/419
7,207,092 B2 * 4/2007 Iwase ..... A44B 19/308 24/419
7,219,402 B2 * 5/2007 Yamazaki ..... A44B 19/308 24/429
2008/0222854 A1 * 9/2008 Keyaki ..... A44B 19/26 24/429
2012/0291235 A1 * 11/2012 Hsu ..... A44B 19/26 24/427
2013/0318751 A1 * 12/2013 Lin ..... A44B 19/42 24/429
2014/0033484 A1 * 2/2014 Hamada ..... A44B 19/26 24/418
2014/0041163 A1 * 2/2014 Hamada ..... A44B 19/308 24/418

* cited by examiner

SLIDER PROVIDED WITH HANDLE AT REAR FOR SLIDE FASTENER

This application is a national stage application of PCT/JP2012/079288, which is incorporated herein by reference.

TECHNICAL FIELD

The present invention relates to a slider used in a slide fastener, and in particular, to a slider for a slide fastener of a type, in which after a slider body is manufactured, a pull tab is attached afterward to the slider body.

BACKGROUND ART

A slider for a slide fastener includes an upper blade, an a lower blade, a guide post for connecting one end portions of the upper blade and the lower blade to each other with a passage gap for elements between the upper blade and the lower blade, a pull tab attachment rod erected from an upper surface of one end of the upper blade, which is located toward the guide post, and extending toward the other end portion, and a pull tab attached to the pull tab attachment rod. The pull tab is attached to the pull tab attachment rod by inserting an attachment shaft portion of the pull tab into a pull tab receiving space between the pull tab attachment rod and the upper surface of the upper blade. In general sliders, after the attachment shaft portion of the pull tab is set in the pull tab receiving space between the pull tab attachment rod and the upper surface of the upper blade, both ends of the pull tab attachment rod are immovably fixed at predetermined positions on the upper surface of the upper blade of the slider body. Accordingly, in such sliders, various pull tabs different in color, pattern, shape or the like cannot be freely attached to the slider body depending on needs or preferences of customers and thus the pull tab cannot be arbitrarily substituted once the pull tab is attached to the slider body.

Instead of such conventional general sliders, many sliders in which a pull tab is attached afterward to a slider body have been also proposed. The typical proposals are disclosed, for example, in WO2010/058465A1 (Patent Document 1), WO2011/086703A1 (Patent Document 2) and the like. According to Patent Documents 1 and 2, a pull tab holding body (pull tab attachment rod) is fixedly installed in cantilever fashion on an upper surface of an upper blade of a slider body in such a manner that one end of the pull tab holding body (pull tab attachment rod) is fixed on a guide post-side end portion, which is a front end portion of the upper surface of the upper blade of the body, and the other end becomes a free end. In this case, the slider disclosed in Patent Document 1, the pull tab holding body and the slider body are separately manufactured and thus upon mounting of the slider, the pull tab holding body is mounted and fixed on the slider body. Meanwhile, in the slider disclosed in Patent Document 2, one end of the pull tab attachment rod is integrally molded in cantilever fashion on one end of the slider body. In either slider, an insertion gap through which an attachment shaft portion of the pull tab can be inserted is formed between the free end of the pull tab attachment rod and the upper blade and is closed by a closure body or a blocking member which is separately prepared after the attachment shaft portion of the pull tab is inserted through the gap.

In the post-attaching type slider disclosed in Patent Document 1, the closure body is slidingly guided in a forward and rearward direction along a sliding path provided on the upper surface of the upper blade for regulating movement in a right and left slider width direction and in an upward and downward direction perpendicular to the upper blade, from the insertion gap at a rear mouth side of the upper blade, which is opposite to the guide post side thereof, to the middle of the pull tab receiving space at the guide post side thereof. The sliding path in Patent Document 1 is a dovetail groove formed so that opening edges formed along right and left end portions of the upper blades are opposed to each other. Meanwhile, on right and left rear end portions of the pull tab holding body, also, a sliding groove having U-shaped cross section is formed so that opening edges thereof are opposed to each other. A guide piece formed along a lower end edge of the closure body and guide pieces formed in a flange shape along right and left upper end edge portions of the closure body are respectively inserted into the dovetail groove and the sliding groove, so that the insertion gap between the pull tab holding body and the upper blade is closed by the closure body, and at the same time the closure body is fixedly held on the pull tab holding body and the upper blade in the upward and downward direction and the right and left direction. As used herein, as to the slider, the upper side means a side of the upper blade, on which the pull tab is attached. On a rear end-side half of the upper surface of the upper blade, a rear recessed portion is formed.

In such configurations, the closure body is set on the rear end portion of the upper surface of the upper blade, and then short protrusion pieces erected on right and left rear end portions of the upper blade of the slider body are previously bent to be generally parallel to the upper surface of the upper blade by crimping. In this case, in order to attach the pull tab to the slider body, a front end portion of the pull tab holding body is fitted and fixed to a front end portion of the upper blade, and at the same time an upper guide piece of the closure body is fitted into the sliding groove arranged in a rear end portion of the pull tab holding body. At this time, a coil spring is previously arranged in the rear recessed portion formed in the upper surface of the upper blade and then the closure body is moved forward at a predetermined position against an elastic force of the coil spring. Then, the attachment shaft portion of the pull tab is inserted through the pull tab insertion gap between the free end of the pull tab holding body and the upper blade, and the pull tab is set at a predetermined position after being received in a part of the pull tab receiving space between the upper blade and the pull tab holding body formed in front of the closure body. When setting is ended, the closure body is moved to an inlet of the insertion gap along the rear recessed portion by an elastic force of the coil spring exerted rearward from the front side thereof. At this time, rear end surfaces of the guide pieces protruding outward along the right and left lower end edges of the closure body comes in contact with front end surfaces of the right and left short protrusion pieces, which are located on the guide post side and the short protrusion pieces serve as a stopper, so that the closure body cannot be retracted further.

In the slider having the pull tab attached to in this way, the pull tab can be detached from the slider body. In order to separate the pull tab, the closure body is first advanced to a position, at which a space through which the pull tab can pass is formed between an upper surface of the closure body and an inner surface of the pull tab holding surface, against an elastic force of the coil spring. In this case, the closure body is remained at that position in a stopped state and then the attachment shaft portion of the pull tab is separated from the part of the pull tab receiving space between the pull tab holding body and the upper blade, thereby detaching the pull tab from the slider body. Subsequently, when restriction of the closure body remained in the middle of the pull tab receiving space is released, the closure body can be easily returned to a position, at which the closure body comes in contact with the short protrusion pieces, by the elastic force of the coil spring and the pull tab is continuously pulled out to be drawn out from the insertion gap. Thus, in the slider proposed in Patent Document 1, the pull tab can be substituted in situ depending on preferences of customers because the pull tab can be freely attached and detached afterward.

Meanwhile, according to the post-attaching slider proposed in Patent Document 2, the slider body and the pull tab attachment rod are initially integrally formed with each other. In the slider described in Patent Document 2, like Patent Document 1, the pull tab attachment rod is integrated in cantilever fashion in such a manner that one end thereof is fixedly installed on the guide post-side end portion of the upper blade of the slider body and the other end becomes a free end portion, and thus an insertion gap through which the attachment shaft portion of the pull tab can be inserted is formed between the free end portion and the upper blade. In a rear end-side half portion of the middle portion, in a width direction, of the upper surface of the upper blade, a rectangular recessed groove is formed to extend to the rear end thereof and a blocking member for closing the inserting gap is fitted in the recessed groove. Also, a leading end of the free end portion of the pull tab attachment rod is of a hook shape curved downward, and a locking step portion adapted to be locked with the blocking member is formed on a lower surface of the hook-shaped leading end portion.

In a first example of typical blocking members disclosed in Patent Document 1, right and left arm portions are provided to horizontally extend rearward in parallel from right and left shoulder portions of a body thereof in a width direction, and also elastic piece portion are likewise provided between the right and left shoulder portions to extend in the same direction as that of the right and left arm portions. The right and left shoulder bodies and the right and left arm portions are formed of a rigid body, and the elastic piece portions have a lodged L-shaped longitudinal section and are elastically deformed at leading ends thereof about bent base end portions in an upward and downward direction. The front end surfaces of the elastic piece portions including the right and left shoulder portions are formed by inclined surfaces inclined downward toward the front thereof, which is the guide post side thereof, and a locking/separating step portions adapted to be locked on and separated from the leading locking step portions of the pull tab attachment piece are provided on the middles of the upper surfaces of the elastic piece portions. A dimension between outer side surfaces of the right and left arm portions including the right and left shoulder portions is equal to a dimension between right and left inner wall surfaces of the rectangular recessed groove, and a dimension between front end surfaces of the shoulder portions and rear end surfaces of the right and left arm portions is equal to a dimension between a front end and a rear end of the recessed groove. A height of the elastic piece portions in the upward and downward direction is equal to a dimension between a bottom surface of the recessed groove of the upper blade and an upper surface of the locking/separating step portions of the pull tab attachment rod. The inclined surfaces is configured to define a large pull tab attachment space between the pull tab attachment rod and the upper blade and to serve as an guide surface for guiding the pull tab so that when the pull tab is pulled rearward to close the slide fastener, a stopped position of the pull tab enters the leading hook-shaped curved portions of the pull tab attachment rod.

In the slider having such configurations, in order to attach the pull tab to the slider body, the attachment shaft portion of the pull tab is inserted through the insertion gap between the free end portion of the pull tab attachment rod and the upper blade, and subsequently, the blocking member is inserted, at the shoulder portions thereof, into an inlet of the recessed groove formed in the upper surface of the upper blade and then is further pushed inward. Upon pushing, the leading end of the pull tab attachment rod pushes the upper surfaces of the elastic piece portions downward from above so that the elastic piece portions are elastically deformed downward. When the locking/separating step portions of the elastic piece portions reach a locking position, at which the locking step portion of the pull tab attachment rod is to be locked therewith, while keeping the elastically deformed state, the elastic piece portions are released from pushing by the leading end surface of the pull tab attachment rod from above and thus elastically returned to an original state. Thus, the locking/separating step portions of the elastic pieces portions are locked on the locking step portion of the pull tab attachment rod, and as a result attaching of the pull tab is completed. In order to detach the pull tab from the slider to which the pull tab is attached, the upper surfaces of the rear ends of the elastic piece portions are pushed to be elastically deformed, so that locking between the locking/separating step portions and the locking step portion is released. Then, the blocking member is moved forward along the recessed groove formed in the upper surface of the upper blade and the attachment shaft portion of the pull tab is drawn out from the insertion gap between the free end of the pull tab attachment rod and the upper blade.

Also, according to a second example of blocking members disclosed in Patent Document 2, the pull tab attachment rod is fixedly installed in cantilever fashion on the upper surface of the shoulder mouths-side end portion (front end portion) of the upper blade of the slider body, and an insertion gap through and from which the attachment shaft portion of the pull tab can be inserted and separated is formed between a rear end thereof and the upper blade. Also, on a leading end of the pull tab attachment rod, one headed pin portion is provided to horizontally protrude rearward. An omission portion is formed by removing a rear end surface of the upper blade by a required height, and on the middle of the remained portion in the width direction, a body insertion space, which is opened upward and has dovetail groove on right and left sides thereof, is formed to allow a main body portion, as described below, of the blocking member to be inserted therein. A bottom surface of the body insertion space is arranged to be flushed with a bottom surface of the omission portion. A guide groove for fitting and guiding a part of the main body portion of the blocking member in a forward and rearward direction is formed on the bottom surface of the body insertion space and the middle, in the width direction, of the surface of the omission portion. In addition, on the bottom surface of the omission portion, right and left protrusion portions are arranged to face the rear end surfaces of the right and left dovetail grooves.

Meanwhile, the blocking member according to the second example described in Patent Document 2, includes a rectangular flat plat-shaped main body portion fitted into the right and left dovetail grooves of the upper blade to be horizontally mounted thereon, an elastic piece portion erected upward from the front end of the main body portion to be curved in a S-shape as viewed from the side thereof and adapted to be elastically deformable in the upward and downward direction, a hole portion formed to extend through the middle of a free end of the elastic piece portion in the forward and rearward direction, a pair of right and left leg portions horizontally extending rearward from the main body portion to be bifurcated and gradually expanded, locking protrusion pieces provided respectively on leading ends of the leg portions to protrude in right and left directions away from each other, and a ridge portion extending to linearly protrude from the middle, in the width direction, of a lower surface of the main body portion. The ridge portion is fitted into the guide groove formed in the middle, in the width direction, of the bottom surface of the upper blade to be slidingly guided in the forward and rearward direction. The hole portion is detachably locked on a head of the headed pin portion formed on the leading end of the pull tab attachment rod. The pair of right and left leg portions can be elastically deformed in the right and left direction (slider width direction).

In such configurations, in order to attach the pull tab to the slider body, the attachment shaft portion of the pull tab is inserted in the pull tab receiving space through the insertion gap between the free end of the pull tab attachment rod and the upper blade, and the main body portion and the right and left leg portions of the blocking member are fitted into the dovetail groove in the upper surface of the upper blade and then are moved forward. During moving, the headed pin portion protruding from the leading end of the free end portion of the pull tab attachment rod is inserted and locked in the hole portion of the upper end of the elastic piece portion of the blocking member. The pair of right and left leg portions, which are being guided along the dovetail groove and moved forward, are elastically deformed as they are advanced so that a distance therebetween in the right and left direction is narrowed. Thus, until a forward curved surface of the S-shaped elastic pieces comes in contact with an inner wall surface of the body insertion space of the upper blade, the right and left leg portions are forcibly elastically deformed so that a distance between leading ends of the locking protrusion pieces provided on the leading ends of the right and left leg portions becomes narrower than an opposing distance between the right and left protrusions erected from the upper surface of the omission portion of the upper blade. When the blocking member is continuously moved in such an elastically deformed state and thus the right and left locking protrusion pieces reach a position of a gap between the vicinity of the rear end surfaces of the right and left dovetail grooves of the upper blade and the right and left protrusions, the elastic deformation force is released so that the locking protrusion pieces are automatically invaded and thus the blocking member is prevented from being further advanced or retracted. Meanwhile, in order to detach the pull tab from the slider body, complex reverse operations have to be performed. Thus, as compared to the first example as described above, the pull tab can be detached, but not easy.

Meanwhile, as sliders having a special structure used for a specified application, a locking slider disclosed in Japanese Utility Model Application Publication S53-36903 (Patent Document 3) is known. The slider is widely used for example in bags, in which a strong force is likely to be exerted on a pull tab, and is used in such a manner that a pair of locking sliders are mounted on a slide fastener chain so that shoulder mouths thereof face each other. On a shoulder mouths-side middle end portion of an upper blade of each of the pair of locking sliders, a locking metal fitting formed by a half-circular metal ring, which is provided with a lock insertion hole, is integrally attached to the upper blade to protrude outward from the upper blade. When locking is needed, the lock insertion holes of the pair of locking metal fittings are overlapped with each other and then a lock rod is inserted through each lock insertion hole, thereby providing locking.

Like Patent Documents 1 and 2, the slider described in Patent Document 3 is entirely also composed of aluminum alloy, copper alloy, zinc alloy or the like. The reason is that metals have a good wear resistance as well as rigidity and strength higher than other materials and also is plastically deformable so that desired products can be obtained by performing in combination or solely machinings, such as die-casting, pressing, crimping or cutting. For example, in Patent Document 1, also, the slider body is molded by die-casting and then when the pull tab is attached thereto, so-called crimping is performed in which a pair of short pieces erected from right and left corners on the shoulder mouths side of the upper surface of the upper blade are pushed and bent at leading ends thereof in direction approaching to each other.

PRIOR ART DOCUMENT

Patent Document

Patent Document 1: WO2010/058465A1

Patent Document 2: WO2011/086703A1

Patent Document 2: Japanese Utility Model Application Publication S53-36903

SUMMARY OF INVENTION

Problems to be Solved by Invention

In the sliders proposed by Patent Documents 1 and 2, as described above, the closure body or the blocking member is fixedly installed on the slider body in a state where movement thereof in the upward and downward and the right and left direction is restricted, and then the insertion gap formed between the upper blade of the slider body and the free end portion of the pull tab holding body or the pull tab attachment rod is closed, thereby ending attaching of the pull tab. Also, when trying to substitute another pull tab with the pull tab attached to the slider body in such a way, as described above, the new pull tab can be substituted and attached after the attached pull tab is first separated from the slider body.

However, for example, according to all structure examples of the slider proposed in Patent Document 1, movement of all closure bodies in the rearward direction is prevented by protrusion short pieces, which are crimped at 90° on the upper blade of the slider body and serve as a stopper, but if a strong force, which overcomes the elastic force of the coil spring, is exerted on the closure bodies forward from the rear side thereof, the closure bodies are moved forward. Therefore, there is a risk that the insertion gap between the upper blade of the slider body and the free end portion of the pull tab holding body, which should have been closed by the closure body, is again formed so that the pull tab comes out from there. In addition, there is a disadvantage that upon assembling of the slider, crimping of the protrusion short pieces is required so that the assembling operation become complicated.

On the other hand, turning to the first slider structure example disclosed in Patent Document 2, a means for fitting and fixing the blocking member to the recessed groove formed in the upper surface of the upper blade includes the right and left inside wall surfaces the inner surface of the recessed groove formed in the upper surface of the upper blade, the bottom surface of the recessed groove, a stepped surface of the locking step portion in the leading hook-shaped curved portion of the pull tab attachment rod, and stepped surfaces formed on tops of the locking/separating step portions of the elastic piece portions in the blocking member. Namely, fixing of the blocking member to the upper blade is just restriction of movement thereof in the right and left direction and the forward obtained by coming in close contact with the inner wall surface of the recessed groove of the upper blade and a front side surface and right and left side surfaces in the right and left inside wall surfaces thereof, restriction of movement thereof in the rear direction obtained by locking between stepped surfaces of the locking step portion and the locking/separating step portions, and restriction of movement thereof in the upward and downward obtained by the bottom surface of the recessed groove and locking between the locking/separating step portions of the blocking member and the locking step portion of the pull tab attachment rod.

Accordingly, when the slide fastener is opened, for example, when a strong force is exerted on the pull tab obliquely upward and rearward, if the free end portion of the pull tab is erected so that locking between the locking step portion and the locking/separating step portions is released, restriction of movement of the blocking member is released so that the blocking member is moved rearward. Thus, the pull tab is likely to be separated from the slider body through the insertion gap between the free end portion of the pull tab and the upper blade. Also, a gap between the insertion gap and the closure body is created and thus other members, such as cloth pieces or straps, on the periphery of the slider are likely to be jammed therein. In addition, other members are likely to be jammed between the stopper or blocking member and the free end portion of the pull tab attachment rod due to a force, by which the pushed stopper or blocking member attempts to be returned to an original blocking state.

Also, in the second slider structure example disclosed in Patent Document 2, the blocking member is configured so that as described above, the main body portion of the right and left leg portions of the blocking member are fitted into the dovetail groove in the upper surface of the upper blade and also the hole portion in the upper end of the elastic piece portion of the blocking member is inserted and locked on the headed pin portion protruding the leading end of the free end portion of the pull tab attachment rod. Also, the pair of right and left leg portions are configured so that in a state where the forward curved surface of the S-shaped elastic piece portion comes in contact with the inner wall surface of the body insertion space of the upper blade, the locking protrusion pieces provided on the leading end of the right and left leg portions are invaded into the gap between the vicinity of the rear end surfaces of the right and left dovetail grooves of the upper blade and the right and left protrusions, so that the blocking member is prevented from being further advanced or retracted.

However, in this state, if a strong force is exerted on the pull tab obliquely upward and rearward so that the free end portion of the pull tab attachment rod is lifted upward, the S-shaped elastic piece portion, which inherently tends to be elastically deformed in the upward and downward, is elastically deformed together to be extended upward. In this state, if the strong force exerted on the pull tab is eliminated, the free end portion of the pull tab rod is returned to an original position, and at the same time, the elastic piece portion is also returned to an original form. At this time, if other members on the periphery are accidently jammed between the free end portion of the pull tab attachment rod and the elastic piece portion, smooth sliding of the slider is disturbed. Further, in the slider structure, there is a disadvantage that the assembling operation of the slider becomes complicated as described. In addition, there is a risk that when an external force is exerted on the blocking member, the hole portion in the upper end of the elastic piece portion of the blocking member is removed from the headed pin portion of the pull tab attachment rod so that the pull tab is separated from the pull tab attachment rod.

Meanwhile, for example, turning to the metal locking slider disclosed in Patent Document 3, unlike general metal sliders described in Patent Documents 1 and 2, a pair of slider are used and also the locking metal fitting formed by a ring body is integrally attached to a body of each slider. In addition, a lock is additionally attached to the pair of the slider. Therefore, because a weight of the entire slide fastener including the lock is increased, the needs for further weight reduction cannot be met.

The present invention has been made keeping in mind the above problems, and a concrete object thereof is to provide a pull tab post-attaching slider, in which a pull tab can be easily attached afterward to a pull tab attachment rod arranged on a slider body so that an assembling operation of the slider can be easily performed, other members, such as thin cloth pieces, can be prevented from being jammed between an upper blade of the slider body and the free end portion of the pull tab attachment rod, and also even if a strong force is exerted to the pull tab attachment rod via the pull tab, the upper blade and the free end portion of the pull tab attachment rod are strongly fixed to each other by a blocking member, which is provided in an insertion gap between the upper blade and the free end portion of the pull tab attachment rod, so that deformation of the free end portion of the pull tab attachment rod can be limited to a minimum. Another object of the present invention is to provide a pull tab post-attaching slider for a slide fastener in which a degree of freedom in selecting materials is large, a simple structure is provided, a weight reduction is possible, and also various processing means can be applied upon manufacturing.

Means for Solving Problems

In order to achieve the above objects, a pull tab post-attaching slider according to the present invention is basically configured so that: a slider body having upper and lower blades is formed integrally with a pull tab attachment rod for holding a pull tab, in cantilever fashion on an upper surface of the upper blade; the pull tab attachment rod comprises a fixed end portion erected from the upper blade and a free end portion such that an insertion gap through which a part of the pull tab can be inserted is formed between the free end portion and the upper blade; and a blocking member for closing the insertion gap is arranged on the slider body, wherein the upper blade of the slider body comprises a first mounting portion for mounting the blocking member, wherein the free end portion of the pull tab attachment rod comprises a second mounting portion for mounting the blocking member, wherein the blocking member comprises a first mounted portion to be mounted on the first mounting portion of the upper blade and a second mounted portion to be mounted on the second mounting portion of the free end portion, wherein one of the first mounting portion and the first mounted portion comprises a first dovetail groove portion and the other includes a first fitting engagement portion having a first fitting engagement structure fitted into and engaged with the first dovetail groove portion, and wherein one of the second mounting portion and the second mounted portion comprises a second dovetail groove portion and the other comprises a second fitting engagement portion having a second fitting engagement structure fitted into and engaged with the second dovetail groove portion.

In particular, according to the pull tab post-attaching slider of the preset invention, at least one of the first fitting engagement structure and the second fitting engagement structure comprises a retracting movement preventing means for preventing the blocking member from being moved in a retracting direction, and the retracting movement preventing means includes locking by a locking claw via an elastic member.

According to the pull tab post-attaching slider of the present invention, preferably, the first dovetail groove portion is arranged in the first mounting portion of the upper blade and the second dovetail groove portion is arranged in the second mounting portion of the free end portion.

In this case, more preferably, the first dovetail groove portion comprises a first recessed groove provided in a peripheral wall of a recessed portion which is provided to be recessed downward from the upper surface of the upper blade, to be recessed at least outward in a slider width direction and having upper and lower inside wall surfaces and a groove bottom surface, and the upper inside wall surface of the first recessed groove is comprised of a protruding piece portion protruding from a position of the groove bottom surface of the first recessed groove toward the recessed portion.

Also, according to the pull tab post-attaching slider of the present invention, preferably, the second dovetail groove portion comprises a pair of second recessed grooves provided to be recessed from right and left side surfaces of the free end portion, which are oriented in a slider width direction, inward in the slider width direction and each having upper and lower inside wall surfaces and a groove bottom surface, and the lower inside wall surface of each of the second recessed grooves is comprised of a ridge portion protruding from a position of the groove bottom surface of each of the second recessed grooves outward in the slider width direction.

In this case, more preferably, the blocking member comprises a base plate portion, a pair of erected plate pieces erected upward from the base plate portion with a predetermined distance therebetween in the slider width direction, and right and left blades extending from upper end portions of the erected plate pieces in directions approaching to each other, and the right and left blades are fitted into and engaged with the pair of the second recessed grooves of the second dovetail groove portion to serve as the second mounted portions.

Further, in this case, particularly preferably, the blocking member comprises a pair of flat plate piece portions extending from the base plate portion outward in the slider width direction and fitted into and engaged with the first recessed groove of the first dovetail groove portion to serve as the first mounted portion, the recessed portion and the first recessed groove of the first dovetail groove portion form an opening on a rear mouth-side end portion of the upper blade, and the base plate portion and the pair of flat plate piece portions of the blocking member are inserted into the recessed portion and the first recessed groove of the first dovetail groove portion through the opening.

In particular, more preferably, the pull tab attachment rod comprises an extension portion arranged between the fixed end portion and the free end portion, a pull tab receiving portion is arranged between the extension portion and the upper surface of the upper blade, the blocking member comprises a pair of locking claws protruding from opposing side surfaces of the right and left blades in directions approaching to each other, and locking spaces for receiving therein and locking thereto the locking claws are arranged in end portions of the pair of second recessed grooves of the second dovetail groove portion, at a side of the pull tab receiving space.

Also, according to the present invention, the blocking member may comprise a pair of locking claws protruding from the pair of flat plate piece portions outward in the slider width direction, and locking spaces for receiving therein and locking thereto the locking claws may be arranged at a shoulder mouths side with respect to the first recessed groove of the first dovetail groove portion in a slider longitudinal direction.

Further, according to the pull tab post-attaching slider of the present invention, the first recessed groove of the first dovetail groove portion or the second recessed grooves of the second dovetail groove portion are arranged to be inclined downward toward a shoulder mouths side in a slider longitudinal direction.

Advantageous Effects of Invention

The pull tab post-attaching slider according to the present invention has a structure in which the pull tab attachment rod is fixedly installed in cantilever fashion on the upper surface of the upper blade of the slider body and the pull tab insertion gap formed between the upper blade of the slider body and the free end portion of the pull tab attachment rod is closed by the blocking member. Also, the upper blade of the slider body includes the first mounting portion for mounting the blocking member and the free end portion of the pull tab attachment rod includes a second mounting portion for mounting the blocking member. In addition, the blocking member includes the first mounted portion to be mounted on the first mounting portion of the upper blade and the second mounted portion to be mounted on the second mounting portion of the free end portion.

Also, according to the present invention, one of the first mounting portion and the first mounted portion includes the first dovetail groove portion and the other includes the first fitting engagement portion having the first fitting engagement structure fitted into and engaged with the first dovetail groove portion. In addition, one of the second mounting portion and the second mounted portion includes the second dovetail groove portion and the other includes the second fitting engagement portion having a second fitting engagement structure fitted into and engaged with the second dovetail groove portion.

In the pull tab post-attaching slider (hereinafter, also simply referred to as the slider) having the above configurations, the blocking member can be easily mounted on the first and second mounting portions of the upper blade and the pull tab attachment rod after an attachment shaft portion of the pull tab is inserted through the insertion gap formed between the upper blade and the free end portion of the pull tab attachment rod. Particularly, in the present invention, the blocking member can be mounted by engagement of the first and second fitting engagement structures to each other without performing complex works, such as crimping, on the upper blade of the slider body and the free end portion of the pull tab attachment rod, and therefore, the slider of a type in which the pull tab is attached afterward, can be very simply assembled.

Further, as the blocking member is provided between the upper blade and the free end portion of the pull tab attachment rod, the upper blade and the free end portion of the pull tab attachment rod can be strongly fixed to each other by the blocking member. Therefore, for example, even if a large force is exerted on the pull tab attachment rod of the slider via the pull tab, a position of the free end portion of the pull tab attachment rod relative to the upper blade can be stably maintained, thereby limiting deformation of the pull tab attachment rod to a minimum.

Thus, in the present invention, the blocking member is engaged to the upper blade and the free end portion of the pull tab attachment rod by the first and second fitting engagement structures, thereby preventing movement of the engaged blocking member in an upward and downward direction and a right and left direction. Accordingly, even if a very large force directed obliquely upward is exerted on the pull tab attachment rod through the pull tab, for example, for the purpose of opening and closing a slide fastener, and thus a force attempting to largely deform the pull tab attachment rod is exerted thereon, the blocking member is strongly engaged to the pull tab attachment rod and the upper blade, so that the blocking member is not easily separated from the first and second mounting portions and also the slider is not damaged.

In addition, the assembled slider of the present invention has a blocking and holding structure securely engaged or fixed to the upper blade of the slider body and the free end portion of the pull tab attachment rod in a state where movement thereof in the upward and downward direction and the right and left direction is automatically prevented. Accordingly, after the pull tab is attached and then the blocking member is mounted on be immovably fixed to the slider body, a blocked state of the insertion gap between the upper blade and the free end portion of the pull tab attachment rod can be maintained. Thus, it is possible to prevent other members, such as thin cloth pieces, from being invaded and jammed between the upper blade of the slider body and the free end portion of the pull tab attachment rod.

Accordingly, when a slide fastener having the slider of the present invention is attached to and used in products, such as clothes or bags, problems caused by jamming of other members in the slider, e.g., in that clothes or bags are pulled by other members or sliding operation of the slider is disturbed by other members, can be prevented. As used herein, the phrase blocked state of the insertion gap means a state where the blocking member is mounted in the insertion gap between the upper blade of the slider body and the free end portion of the pull tab attachment rod and also the receiving space for the attachment shaft portion of the pull tab formed between the upper blade and the pull tab attachment rod is delimited by the blocking member without a gap.

A material for the pull tab post-attaching slider according to the present invention is not limited to metal materials, but can employ synthetic resin materials. Accordingly, even if having a complex structure in which, in the case of metal materials, pressing or bending would have required, the slider can be manufactured by injection molding or the like, and also, if a metal locking slider having a structure as described already above is made of synthetic resin materials, a significant weight reduction thereof can be achieved.

Exemplary synthetic resin materials suitable for the slider may include polyacetal resin, polyamide resin, polybutylene terephthalate resin and the like. Like the post-attaching slider disclosed in Patent Document 2 above, the pull tab post-attaching slider of the present invention does not allow other member to be invaded into the insertion gap because the blocked state of the insertion gap is maintained when the blocking member is mounted on the first mounting portion of the slider body.

Also, according to the slider of the present invention, a method of attaching the pull tab on the pull tab attachment rod is not particularly limited. For example, as described above, attaching of the pull tab can be performed by mounting and fixing the blocking member on the mounting portion of the slider body after the pull tab is held on the pull tab attachment rod. Also, for example, after the blocking member is mounted on the first and second mounting portion of the slider body before the pull tab is held on the pull tab attachment rod, the blocking member may be slightly moved forward so that the insertion gap for the pull tab between the upper surface of the upper blade and the free end portion of the pull tab attachment rod is again formed, and then after the attachment shaft portion of the pull tab is inserted through the insertion gap, the blocking member may be returned to the first and second mounting portions of the upper blade and the pull tab attachment rod so that the first and second mounted portions of the blocking member are locked on the first and second mounting portions, thereby achieving the blocked state. At this time, if the blocking member is always urged from the front thereof by an elastic member, the blocking member is not arbitrarily moved forward. Also, if the structure in which the blocking member can be moved forward as described above is employed, different types of pull tabs can be substituted with each other.

In particular, according to the slider of the preset invention, at least one of the first fitting engagement structure and the second fitting engagement structure includes the retracting movement preventing means for preventing the blocking member from being moved in the retracting direction, and the retracting movement preventing means includes locking by a locking claw via an elastic member. Thus, when the blocking member is mounted on the upper blade of the slider body and the free end portion of the pull tab attachment rod, a movement preventing means in the upward and downward direction and the right and left direction and a retracting movement preventing means provided the first and second mounting portions and the first and second mounted portions of the blocking member is functioned so that the blocking member can be mounted (fixed) to the upper blade and the pull tab attachment rod in a state where movement thereof in the upward and downward direction and the right and left direction and also the retracting direction is automatically prevented without performing a special operation on the movement preventing means. Also, after the blocking member is mounted, it is possible to prevent the blocking member from being retracted (moved in a direction opposite to the mounting direction) and also to stably prevent the blocking member from being separated from the upper blade and the free end portion of the pull tab attachment rod.

In this slider of the present invention, the first dovetail groove portion is arranged in the first mounting portion of the upper blade and the second dovetail groove portion is arranged in the second mounting portion of the free end portion. Thus, the slider can be constructed in a simple structure. Also, the blocking member can be easily and stably mounted on the upper blade and the free end portion of the pull tab attachment rod.

In this case, the first dovetail groove portion includes the first recessed groove provided in a peripheral wall of the recessed portion, which is provided to be recessed downward from the upper surface of the upper blade, to be recessed at least outward in the slider width direction and also having the upper and lower inside wall surfaces and the groove bottom surface. Also, the upper inside wall surface of the first recessed groove is comprised of the protruding piece portion protruding from a position of the groove bottom surface of the first recessed groove toward the recessed portion. Thus, the first mounted portion of the blocking member can securely fitted into the first recessed groove of the upper blade and therefore can be stably engaged in the first dovetail groove portion. In addition, upward and downward movement of the blocking member mounted in the first dovetail groove portion can be limited by the protrusion piece portion forming the upper inside wall surface of the first recessed groove. Accordingly, even if the pull tab of the slider is pulled so that a strong force is exerted on the pull tab attachment rod, engagement (mounted state) of the blocking member with the upper blade can be stably maintained, thereby effectively preventing deformation of the pull tab attachment rod.

Further, according to the slider of the present invention, the second dovetail groove portion includes the pair of second recessed grooves provided to be recessed from right and left side surface of the free end portion, which are oriented in the slider width direction, inward in the slider width direction and also having the upper and lower inside wall surfaces and the groove bottom surface. Also, the lower inside wall surface of each second recessed groove is comprised of the ridge portion protruding from a position of the groove bottom surface of the second recessed groove outward in the slider width direction.

Thus, the second mounted portion of the blocking member can securely fitted into the second recessed grooves of the second dovetail groove portion provided in the free end portion of the pull tab attachment rod and therefore the second mounted portion can be stably engaged in the second dovetail groove portion. In addition, upward and downward movement of the blocking member mounted in the second dovetail groove portion can be limited by the ridge portion forming the lower inside wall surface of the second recessed groove. Accordingly, even if the pull tab of the slider is pull so that a strong force is exerted on the pull tab attachment rod, engagement (mounted state) of the blocking member with the free end portion of the pull tab attachment rod can be stably maintained, thereby effectively preventing deformation of the pull tab attachment rod.

In this case, the blocking member includes the base plate portion, the pair of erected plate pieces erected upward from the base plate portion with a predetermined distance therebetween in the slider width direction, and the right and left blades extending from upper end portions of the erected plate pieces in directions approaching to each other. Also, the right and left blades as the second mounted portions are fitted into and engaged with the pair of the second recessed grooves of the second dovetail groove portion. Thus, the right and left blades, which are the second mounted portion of the blocking member, can be easily inserted and stably engaged in the second dovetail groove provided in the free end portion of the pull tab attachment rod.

Further, according to the present invention, the blocking member includes the pair of flat plate piece portions extending from the base plate portion of the blocking member outward in the slider width direction and, as the first mounted portion, fitted into and engaged with the first recessed groove of the first dovetail groove portion of the upper blade. Also, the recessed portion arranged in the upper blade and the first recessed groove of the first dovetail groove portion have the opening on a rear mouth-side end portion of the upper blade. Thus, the base plate portion and the pair of flat plate piece portions of the blocking member can be easily inserted and stably engaged in the recessed portion of the upper blade and the first recessed groove of the first dovetail groove portion through the opening.

Further, according to the slider of the present invention, the pull tab attachment rod includes the extension portion arranged between the fixed end portion and the free end portion, and the pull tab receiving portion is arranged between the extension portion and the upper surface of the upper blade. Also, the blocking member includes the pair of locking claws protruding from opposing side surfaces of the right and left blades in directions approaching to each other, and locking spaces for receiving therein and locking thereto the locking claws of the blocking member are arranged in end portions of the pair of second recessed grooves of the second dovetail groove portion provided in the pull tab attachment rod, which are located toward the pull tab receiving space Thus, when the blocking member is mounted on the upper blade of the slider body and the free end portion of the pull tab attaching rod, the pair of locking claws provided on the blocking member can be stably engaged in the locking spaces provided in the second dovetail groove portion. Accordingly, the blocking member mounted on the upper blade and the pull tab attachment can be prevented from being moved in a direction (rearward direction) opposite to the pull tab receiving portion by locking of the locking claws, thereby effectively preventing separation of the blocking member.

More specifically, in order to attach the pull tab to the slider having the above configurations, the attachment shaft portion of the pull tab is first inserted through the insertion gap between the upper surface of the upper blade and the free end portion of the pull tab attachment rod and then is inserted and held in the pull tab receiving space at the end side thereof. Then, leading ends of the pair of flat plate piece portion (flange-like plate pieces) in the first mounted portion of the blocking member are fitted into the right and left first dovetail groove portions, which are the first mounting portion of the upper blade. At the same time, the locking claws are fitted into the second dove tail groove portion formed in the free end portion of the pull tab attachment rod while elastically deforming the right and left blade pieces, which are the second mounted portion of the blocking member, together with the right and left erected portions, in the right and left direction.

When the fitting operation is continued so that the right and left locking claws of the second mounted portion reach the locking spaces provided in the second mounting portion, the right and left erected portions and the right and left blade pieces of the blocking member are elastically returned so that the locking claws are locked on wall surface (locking surfaces) defining the locking spaces and at the same time the right and left blade pieces are fitted into the second dovetail groove portion. At the same time, the pair of flat plate piece portions (flange-like plate pieces), which are the first mounted portion of the blocking member, are also fitted into the first dovetail groove portion, which is the first mounting portion of the upper blade.

After the blocking member is mounted on the slider body and the pull tab attachment rod in this way, fitting and coupling of the blocking member to the first and second dovetail groove portions prevents is configured so that the groove bottoms of the first and second dovetail groove portions prevent movement of the associated members in the right and left direction and also the upper and lower inside wall surfaces of the first and second dovetail groove portions prevent movement of the associated members in the upward and downward direction.

Also, as the locking claws are locked on end portions of the free end portion of the pull tab attachment rod, which are located toward the pull tab receiving portion, the blocking member can be prevented from being moved rearward. As a result, upon opening and closing operations of the slide fastener, for example, even if a strong force is exerted on the pull tab horizontally rearward or obliquely upward and rearward and thus a strong force is exerted on the blocking member rearward or on a leading curved portion of the pull tab attachment rod from the inner surface thereof obliquely upward, each force is received by the strong coupling force of the first and second mounted portion of the blocking member with the first mounting portion of the upper blade and the second mounting portion of the pull tab attachment rod. Accordingly, movement of the blocking member in the upward and downward direction and the right and left direction and also in the rearward direction can be prevented, thereby preventing such a deformation of the pull tab attachment rod that a damage thereof can be caused.

In the foregoing, although one preferable aspect of the first and second mounted portion and the first and second mounting portion of the present invention are illustrated, various modifications other than that can be made as described below. For example, according to the slider of the invention, the blocking member may include the pair of locking claws protruding from the pair of flat plate piece portions outward in the slider width direction, and locking spaces for receiving therein and locking thereto the locking claws may be arranged at a shoulder mouths side with respect to the first recessed groove of the first dovetail groove portion provided in the upper blade in a slider longitudinal direction.

In this slider structure, also, when the blocking member is mounted on the upper blade of the slider body and the free end portion of the pull tab attachment rod, the locking claws provided respectively on the pair of flat plate piece portions of the blocking member can be stably locked in the locking space provided in the first dovetail groove portion. Thus, the blocking member mounted on the upper blade and the pull tab attachment rod can be prevented from being moved rearward, thereby effectively preventing separation of the blocking member.

Further, according to the slider of the present invention, the first recessed groove of the first dovetail groove portion provided in the upper blade or the second recessed grooves of the second dovetail groove portion provided in the free end portion of the pull tab attachment rod are arranged to be inclined downward toward a shoulder mouths side in the slider longitudinal direction. By having such a configuration, after the blocking member is mounted on the upper blade of the slider body and the free end portion of the pull tab attachment rod, even if the pull tab is pulled so that a strong force is exerted on the pull tab attachment rod, the blocking member can be hardly moved to a rear mouth side in the slider longitudinal direction. Therefore, engagement (mounted state) of the blocking member with the upper blade and the free end portion of the pull tab attachment rod can be stably maintained, thereby more effectively preventing separation of the blocking member and also more effectively preventing deformation of the pull tab attachment rod.

EMBODIMENTS OF INVENTION

Preferable embodiments of the present invention will be now described in detail with reference to examples and drawings. Meanwhile, the invention is not limited to each embodiment as described below and thus various modifications can be made thereto so long as they include the substantially same configurations as those of the invention and also achieve the same effect.

For example, because a slide described with regard to each of the following embodiments is used in a slide fastener having coil-shaped continuous element rows, flanges are only arranged on only an upper blade. However, the present invention is not limited to this and can be similarly applied, for example, a slider which is used to a slide fastener, in which separate elements are attached to fastener tapes by injection molding, and has flanges arranged on both upper and lower blades, or the like. Also, although a material of the slider is not particularly mentioned with regard to the illustrated embodiments, either of metals and synthetic resins can be employed.

Embodiment 1

Figure 1:
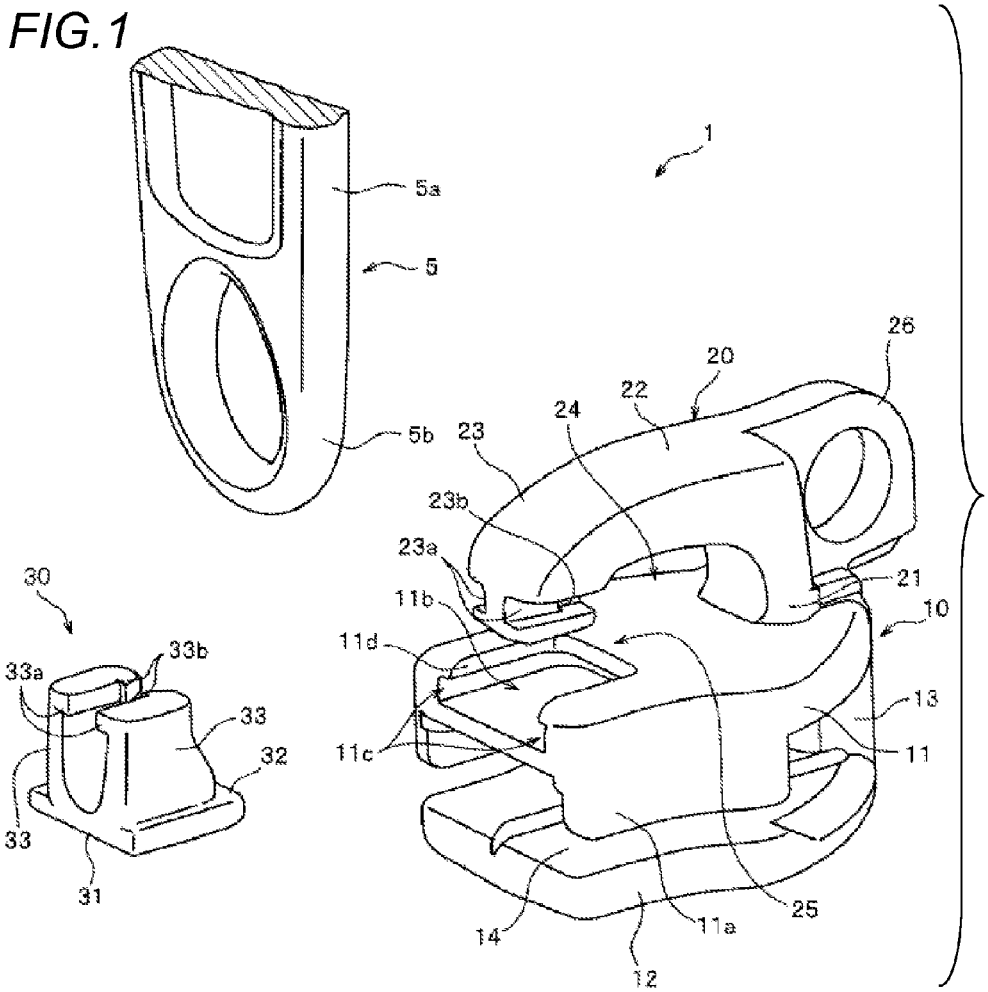
FIG. 1 is an exploded perspective view of a pull tab post-attaching slider for a slide fastener according to an embodiment 1 of the present invention.
Figure 2:
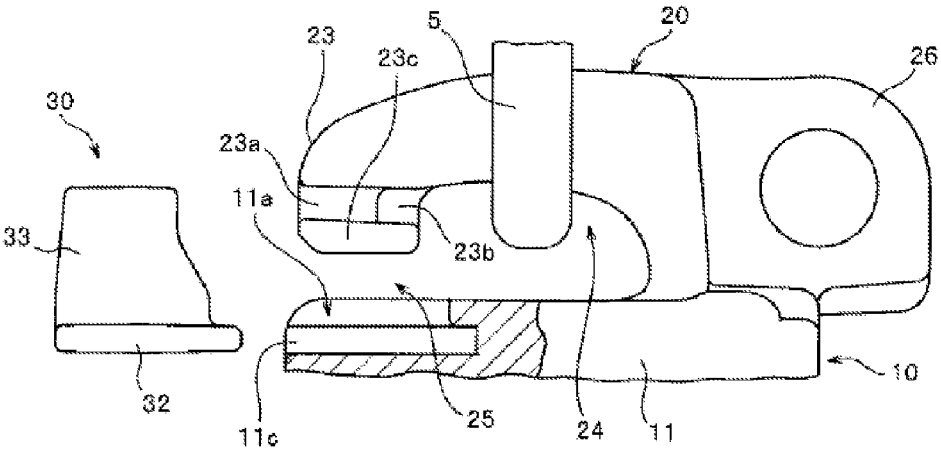
FIG. 2 is a partial side view, partially cutaway, showing the slider before a blocking member is mounted thereon.
Figure 3:
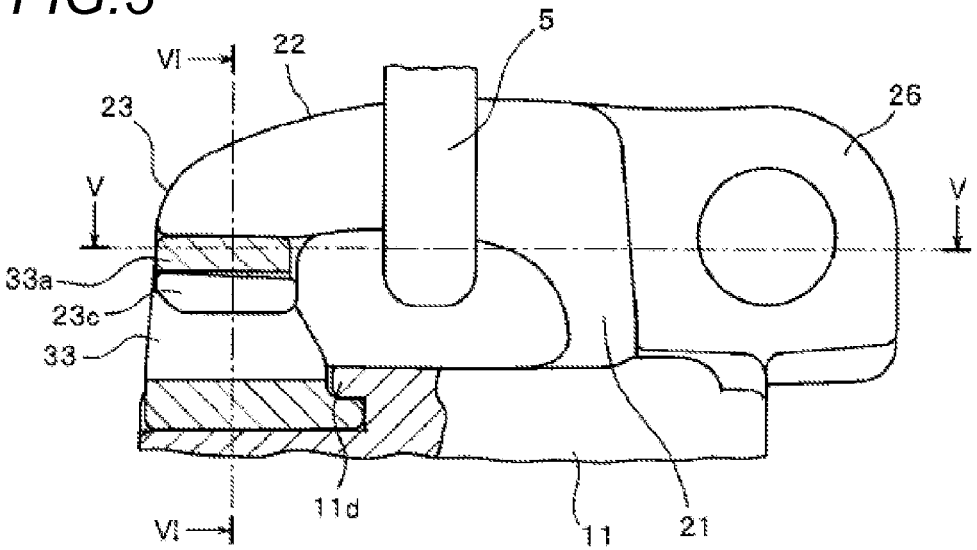
FIG. 3 is a partial side view, partially cutaway, showing the slider after the blocking member is completely mounted thereon.
Figure 4:
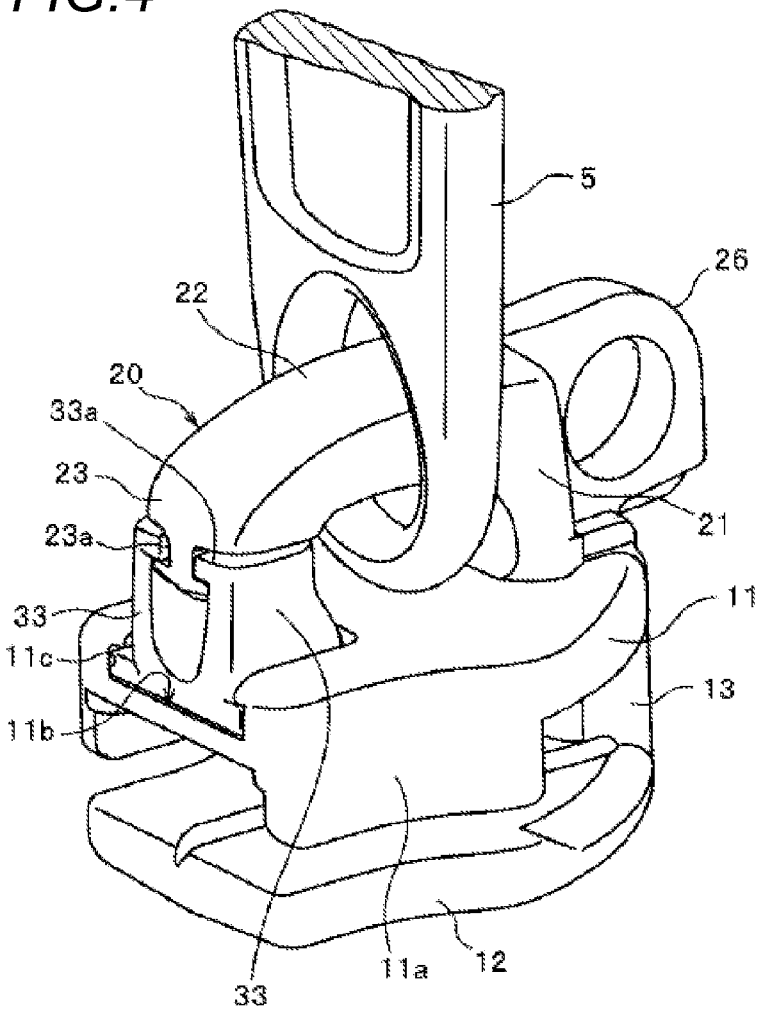
FIG. 4 is a perspective view showing a main part of the slider after the blocking member is completely mounted thereon.
Figure 5:
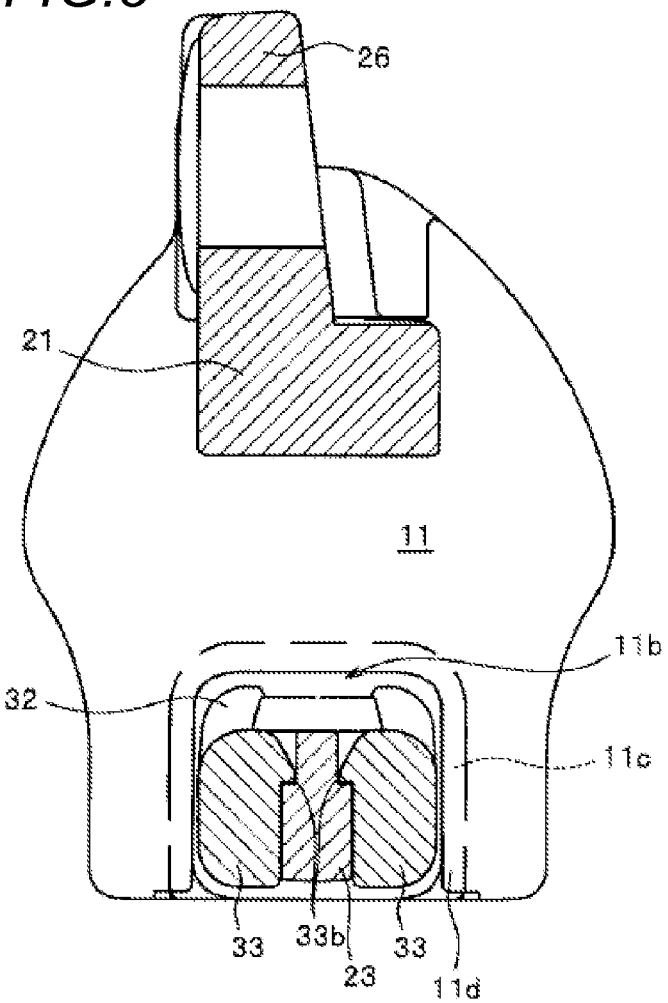
FIG. 5 is a sectional view taken along a V-V line of FIG. 3 as viewed in an arrow direction therein.
Figure 6:
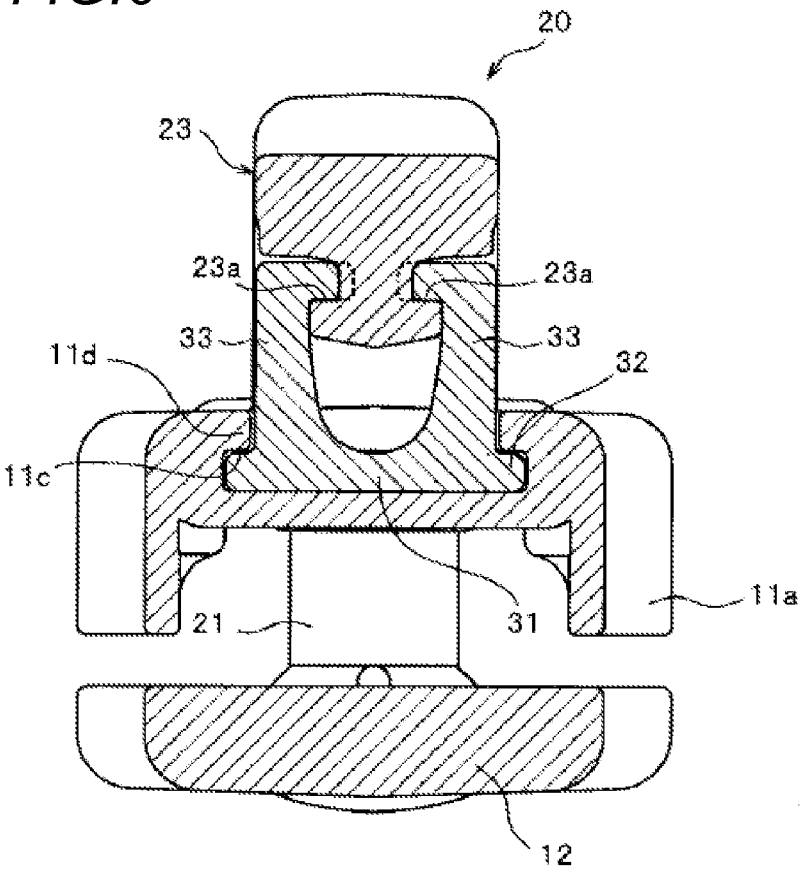
FIG. 6 is a sectional view taken along a VI-VI line of FIG. 3 as viewed in an arrow direction therein.

FIGS. 1 to 6 shows a pull tab post-attaching slider (hereinafter, simply referred to as a slider) for a slide fastener according to an embodiment 1 of the present invention, in which FIG. 1 is an exploded perspective view of the slider, FIGS. 2 to 4 are explanatory views upon assembling of the slider, FIG. 5 is a sectional view taken along a V-V line of FIG. 3 as viewed in an arrow direction therein, and FIG. 6 is a sectional view taken along a VI-VI line of FIG. 3 as viewed in an arrow direction therein.

Meanwhile, in the following description, a sliding direction of the slider is referred to as a forward and rearward direction, and in particular, a direction along which the slider moves to engage element rows of a slide fastener with each other is referred to as the forward direction and a direction along which the slider moves to disengage coil-shaped element rows from each other is referred to as the rearward direction. Also, a height direction of the slider is referred to as an upward and downward direction, and in particular, a direction of a side of a slider body to which a pull tab is attached is referred to the upward direction and the opposite direction is referred to as the downward direction. In addition, right and left sides in a width direction of the slider as viewed from the front thereof is referred to as a right and left direction.

The slider 1 of the present embodiment 1 includes a slider body 1, a pull tab attachment rod 20 integrally fixed in cantilever fashion on the slider body 10, a blocking member 30 mounted in a pull tab insertion gap 25 between an upper surface of the slider body 10 and a free end portion 23 of the pull tab attachment rod 20, and a pull tab 5 held on the pull tab attachment rod 20. The pull tab 5 has a flat plate-shaped pull tab main body 5*a* capable of being gripped by fingers and an annular attachment shaft portion 5*b* integrally formed with one end of the pull tab main body 5*a*.

In the slider 1 of the present embodiment 1, the slider body 10, the pull tab attachment rod 20, the blocking member 30 and the pull tab 5 is manufactured by die-casting or injection molding using a metal material, such as aluminum alloy or zinc alloy, or a synthetic resin material including, singly or in combination, polyacetal resin, polyamide resin, polybutylene terephthalate resin and the like. Meanwhile, in the present invention, materials of these members are not particularly limited but can be arbitrarily changed depending on applications thereof.

However, the pull tab attachment rod 20 of the present embodiment 1, as shown in FIG. 1, has a ring-shaped locking member 26 integrally formed to protrude forward from a right half of a front end surface of a fixed end portion 21 of the pull tab attachment rod 20 of the slider 1. As also described in Patent Document 3 above, such a slider is configured so that two slider, which typically have the same shape, are attached on a fastener chain, not shown, in a state where end portions thereof each provided with a locking metal fitting face each other, and then a lock, not shown, is inserted through locking holes formed in the centers of the locking metal fittings in a state where the locking holes are overlapped with each other, thereby locking the sliders. Accordingly, if a single metal slider or two metal sliders and a lock are used, an increase in weight is caused particularly in the case of large luggage or the like and such a weight problem cannot be ignored.

The slider 1 according to the present invention can be all made of synthetic resin materials, instead of metal materials. In this way, when the slider 1 is constructed using synthetic resin material, a significant weight reduction of the slider 1 can be achieved. Of course, it goes without saying that the slider may be manufactured may be made of metal materials.

Referring to FIG. 1, the slider body 10 of the slider 1 has upper and lower blades 11 and 12 arranged to be parallel to each other, a guide post 13 connecting front end portions of the upper and lower blades 11 and 12 with each other, and flanges 11*a* suspended from right and left edges of the upper blade 11 toward the lower blade 12.

Shoulder mouths are formed on right and left sides of a front portion of the slider body 10 with the guide post 13 interposed therebetween, and a rear mouth is formed in a rear end of the slider body 10. Also, a Y-shaped element guide path 14 for communicating the right and left shoulder mouths with one rear mouths is formed between the upper and lower blades 11 and 12. Also, on an upper surface of the upper blade 11 of the slider body 10, a rectangular recessed portion 11*b*, in which the blocking member 30 can be mounted, is formed to extend forward from a rear end (rear mouth-side edge end) of the upper blade 11. The rectangular recessed portion 11*b* has a bottom surface parallel to the upper surface of the upper blade 11 and also serves as a part of a first mounting portion for mounting the blocking member 30 according to the present invention. A first dovetail groove portion 11*c* is continuously formed in right and left wall surfaces of the rectangular recessed portion 11*b* and a front wall surface in a depth direction thereof.

The first dovetail groove portion 11*c* includes a first recessed groove having a U-shaped wall surface formed along a periphery of the rectangular recessed portion 11*b*. Namely, the first recessed groove is provided on a portion of the rectangular recessed portion 11*b*, which corresponds to a peripheral wall thereof (i.e., right and left walls and front wall), to be recessed outward from the rectangular recessed portion 11*b* and also to be parallel to the bottom surface of the rectangular recessed portion 11*b*. Also, the first recessed groove has a lower inside wall surface flushed with the bottom surface of the rectangular recessed portion 11*b*, a groove bottom surface formed to be continued from the lower inside wall surface, and an upper inside wall surface formed to be continued from the groove bottom surface and arranged to be parallel to the lower inside wall surface.

In this case, above a space portion (interior space) of the first recessed groove, a protrusion piece portion 11*d* is arranged to protrude in a collar shape from a position of the groove bottom surface of the first recessed groove toward the recessed portion 11*b*. The upper inside wall surface of the first recessed groove of the first dovetail groove portion 11*c* is defined by the protrusion piece portion 11*d*.

Because the first dovetail groove portion 11*c* has the first recessed groove having the upper inside wall surface defined by the protrusion piece portion 11*d*, a flange-like plate piece (flat plate piece portion) 32, as described below, of the blocking member 30 can be securely fitted and stably engaged in the first recessed groove of the first dovetail groove portion 11*c*, thereby effectively inhibiting the blocking member 30 from being moved relative to the upper blade 11 in an upward and downward direction.

Alternatively, according to the present invention, the first recessed groove of the first dovetail groove portion 11*c* may be provided in at least portions of the recessed portion, which correspond to the right and left side walls thereof, to be recessed outward in a slider width direction, and for example, the slider body may be constructed without providing the first recessed groove in a portion of the recessed portion, which corresponds to the front side wall thereof (in other words, without providing the front protrusion piece portion 11*d* protruding rearward). Of course, it goes without saying that providing the first recessed groove in the peripheral wall in three directions of the rectangular recessed portion 11*b* as in the present embodiment 1 is preferable because an engaging force between the upper blade 11 and the blocking member 30 can be increased.

The slider body 10 is integrally provided with the pull tab attachment rod 20 having a fixed end portion 21 erected from the front end portion of the upper blade 11 (side further forward than the middle thereof in a front and rear direction of the slider 1), an extension portion 22 bent to extend rearward from the fixed end portion 21, and a free end portion 23 bent downward from the extension portion 22 toward the upper blade 11. In the present embodiment 1, the fixed end portion 21 of the pull tab attachment rod 20 is integrally molded on the upper surface of the upper blade 11 at the same time as molding of the slider body 10.

Because the pull tab attachment rod 20 is integrally molded on the slider body 10, fixation strength of the pull tab attachment rod 20 can be enhanced and when the pull tab 5 is strongly pulled after the pull tab 5 is attached to the pull tab attachment rod 20, deformation of the pull tab attachment rod itself due to a tensile force can be effectively prevented.

Also, according to the present embodiment 1, the pull tab attachment rod 20, as shown in FIG. 2, is generally of a downward horizontal C-shape as viewed from the side, and a receiving space 24 for receiving and holding the attachment shaft portion 5*b* of the pull tab 5 is formed between a lower end surface of the extension portion 22 of the pull tab attachment rod 20 and the upper surface of the upper blade 11.

As shown in FIG. 1, the free end portion 23 of the pull tab attachment rod 20 is formed to have an insertion gap 25 through which the attachment shaft portion 5*b* of the pull tab 5 can be inserted between the free end portion 23 and the upper surface of the upper blade 11. Also, on right and left side surfaces of the free end portion 23 of the pull tab attachment rod 20, second dovetail groove portions 23*a* are formed to be slightly inclined forward and downward relative to the upper surface of the upper blade 11. In other words, the second dovetail groove portions 23*a* are inclined downward toward the pull tab receiving space 24.

The second dovetail groove portions 23*a* include a pair of second recessed grooves provided to be recessed from the right and left side surfaces of the free end portion 23 inward in the slider width direction. The second recessed grooves have a U-shaped wall surface including a lower inside wall surface, a groove bottom surface formed to be continued from the lower inside wall surface and an upper inside wall surface formed to be continued from the groove bottom surface and arranged to face the lower inside wall surface. In this case, below a space portion (interior space) of each of the second recessed grooves, a ridge portion 23*c* is arranged to protrude from a position of the bottom surface of the second recessed groove outward in the slider width direction. The lower insider wall surfaces of the second recessed grooves of the second dovetail groove portions 23*a* are defined by the ridge portion 23*c*.

Because the second dovetail groove portions 23*a* includes the second recessed grooves having the lower inside wall surface defined by the ridge portion 23*c*, right and left blade pieces 33*a*, as described below, of the blocking member 30 can be securely fitted and stably engaged in the second recessed grooves of the second dovetail groove portions 23*a*, thereby effectively inhibiting the blocking member 30 from being moved relative to the free end portion 23 in the upward and downward direction (or the free end portion 23 from being moved relative to the blocking member 30 in the upward and downward direction).

In end portions (front end portions) of the second dovetail groove portions 23*a* of the free end portion 23 which are located toward the pull tab receiving space 24, locking surfaces are formed in a locking spaces 23*b* defined by step portions, which are cutout in a rectangular shape in a direction further increasing a depth of the second dovetail groove portions 23*a* and allow locking claws 33*b* of the blocking member 30, as described below, to be locked thereon. The second dovetail groove portions 23*a* and the locking spaces 23*b* are a part of a second mounting portion, in which the right and left blade pieces 33, as described below, of the blocking member 30 are fitted to be fixed thereto. In addition, ridges on a rear end opening of each of the second dovetail groove portions 23*a* of the free end portion 23 of the pull tab attachment rod 20 and the first dovetail groove portion 11*c* of the recessed fitting portion 11*b* formed in the upper blade 11 or on fitting ends of the first dovetail groove portion 11*c* and the second dovetail groove portions 23*a* are chamfered.

Due to chamfering, when mating coupling members (i.e., a first mounted portion and a second mounted portion of the blocking member 30 as described below) are fitted into the first dovetail groove portion 11*c* and the second dovetail groove 23*a*, inserting thereof can be facilitated and also when the blocking member 30 is inserted into the recessed fitting portion 11*b* of the upper blade 11, the right and left claws 33*b*, as described below, formed on an upper end of the blocking member 30, can be easily elastically deformed in a horizontal direction.

The blocking member 30 according to the present embodiment 1 is comprised of a base plate portion 31 fitted into and mounted on the first dovetail groove portion 11*c* formed in the inner wall surface of the recessed fitting portion 11*b* of the upper blade 11, a U-shaped flange-like plate piece 32 extending in parallel to protrude from right and left side edges and a front end edge of the base plate portion 31 of a rectangular shape outward in three directions, a pair of right and left erected plate pieces 33 erected from right and left sides of an upper surfaces of the base plate portion 31 to be parallel to each other, right and left blade pieces 33*a* extending from inner surfaces of upper ends of the erected plate pieces 33 in directions opposite to each other, and locking claws 33*b* protruding toward opposing side surface of front end portions of the right and left blade pieces 33*a*. Herein, the right and left erected plate pieces 33 can be bumped against an elastic member of the present invention and thus elastically deformed in the right and left direction. In the present embodiment 1, locking of a pair of the right and left locking claws 33*b* on the locking surfaces of the locking spaces 23*b* constitutes a retracting movement preventing means for preventing the blocking member 30 from being moved rearward (being retracted).

In order to assembly the slider 1 of the present embodiment 1 using components as described above, as shown in FIG. 2, the attachment shaft portion 5*b* of the pull tab 5 is first received and held in the receiving space 24 between the extension portion 22 of the pull tab attachment rod 20 and the upper surface of the upper blade 11 via the pull tab insertion gap 25 between the free end portion 23 of the pull tab attachment rod 20 and the upper surface of the upper blade 11. Then, as shown in FIG. 3, the U-shaped flange-like plate piece 32 of the blocking member 30 is fitted into the first dovetail groove portion 11*c* formed in the inner wall surface (inner circumferential surface) of the recessed portion 11*b* of the upper blade 11 and also the right and left blade pieces 33*a* on the upper ends of the erected plate pieces of the blocking member 30 are fitted into the right and left second dovetail groove portions 23*a* formed in the free end portion 23 of the pull tab attachment rod 20.

When the right and left blade pieces 33*a* of the blocking member 30 are fitted into the right and left second dovetail groove portions 23*a* of the pull tab attachment rod 20, the fitting operation is first performed while the right and left erected plate pieces 33 are elastically deformed and expanded in the right and left direction, because a dimension between the bottom surfaces of the right and left second dovetail groove portions 23*a* in the slider width direction is larger than a dimension of a gap between leading ends of the right and left locking claws 33*b*. At this time, because leading end surfaces of the locking claws 33*b* are formed in an arc shape, the arc-shaped surfaces of the locking claws 33*b* are guided in the right and left direction by the second dovetail groove portion 23*a* when the fitting operation of the blocking member 30 is performed to push the leading end surfaces of the locking claws 33*b* toward the second dovetail groove portions 23*a*, so that the pair of erected plate pieces 33 are automatically elastically deformed in the right and left direction and thus a distance between the right and left locking claws 33*b* are expanded in the right and left direction.

In this state, while the fitting operation of the blocking member 30 is continued, if the locking claws 33*b* reach a claw locking portion formed by the step portions which are formed in the leading end portions of the second dovetail groove portions 23*a*, forces which are expanded in the right and left direction is eliminated so that the right and left erected plate pieces 33 are elastically returned to an original state and at the same time the right and left locking claws 33*b* are fitted and locked in the locking spaces 23*b* of the claw locking portions formed by the step portions. At the same time, a front end surface of the flange-like plate piece 32 extending forward from the base plate 31 of the blocking member 30 comes in close contact with the depth direction-side wall surface of the first dovetail groove portion 11*c* formed in the three-direction wall surfaces of the recessed portion 11*b* of the upper blade 11, and thus the fitting operation of the blocking member 30 into the first dovetail groove portion 11*c* is ended. Thus, as shown in FIGS. 4 to 6, the slider 1 can be easily assembled without crimping the slider body 10 or the pull tab attachment rod 20.

In the slider 1 assembled in this way, the U-shaped flange-like plate piece 32 extending from the base plate portion 31 of the blocking member 30, which is the first mounted portion, and the right and left blade pieces 33*a* and locking claws 33*b* formed on the upper ends of the erected pieces, which are the second mounted portion of the blocking member 30, are respectively strongly locked in the first dovetail groove 11*c* of the recessed fitting portion 11*b*, which is the first mounting portion arranged on the slider body 10, and the second dovetail groove portions 23*a* and the locking spaces 23*b* of the claw locking portion, which are the second mounting portion arranged on the pull tab attachment rod 20, and also the blocking member 30 are coupled and fixed to the upper blade 11 of the slider body 10 and the pull tab attachment rod 20 in a state where a relative movement thereof in the upward and downward direction, the right and left direction and the rear direction is prevented.

Namely, because main coupling of the blocking member 30 to the slider body 10 and the pull tab attachment rod 20 in the present embodiment 1 is coupling portions between the first dovetail groove portion 11*c* and second dovetail groove portions 23*a* of the slider body 10 and the pull tab attachment rod 20 and the blocking member 30, which is fitted into and thus coupled to the first dovetail groove portion 11*c* and the second dovetail groove portions 23*a*, movement thereof in the upward and downward direction and the right and left direction is prevented, and at the same time, due to locking between the locking surfaces, which are formed inside the second dovetail groove portions 23*a* of the pull tab attachment rod 20, and the locking claws 33*b* of the blocking member 30, movement of the blocking member 30 in the rear direction is also prevented.

Accordingly, the blocking member 30 is strongly connected to both of the slider body 10 and the pull tab attachment rod 20, so that, for example, even if a strong force, which can separate the blocking member 30 from the slider body 10 and the pull tab attachment rod 20, is exerted on the pull tab 5, the blocking member 30 is kept immobilized at the fixed position and thus so large deformation is not caused on the pull tab attachment rod 20. In addition, because the second dovetail groove 23*a* are inclined forward and downward, when a strong force is exerted on the pull tab attachment rod 20 as described above, a force in a directing advancing the blocking member 30 is exerted thereon, thereby more effectively preventing separation of the blocking member 30.

Embodiment 2

Figure 7:
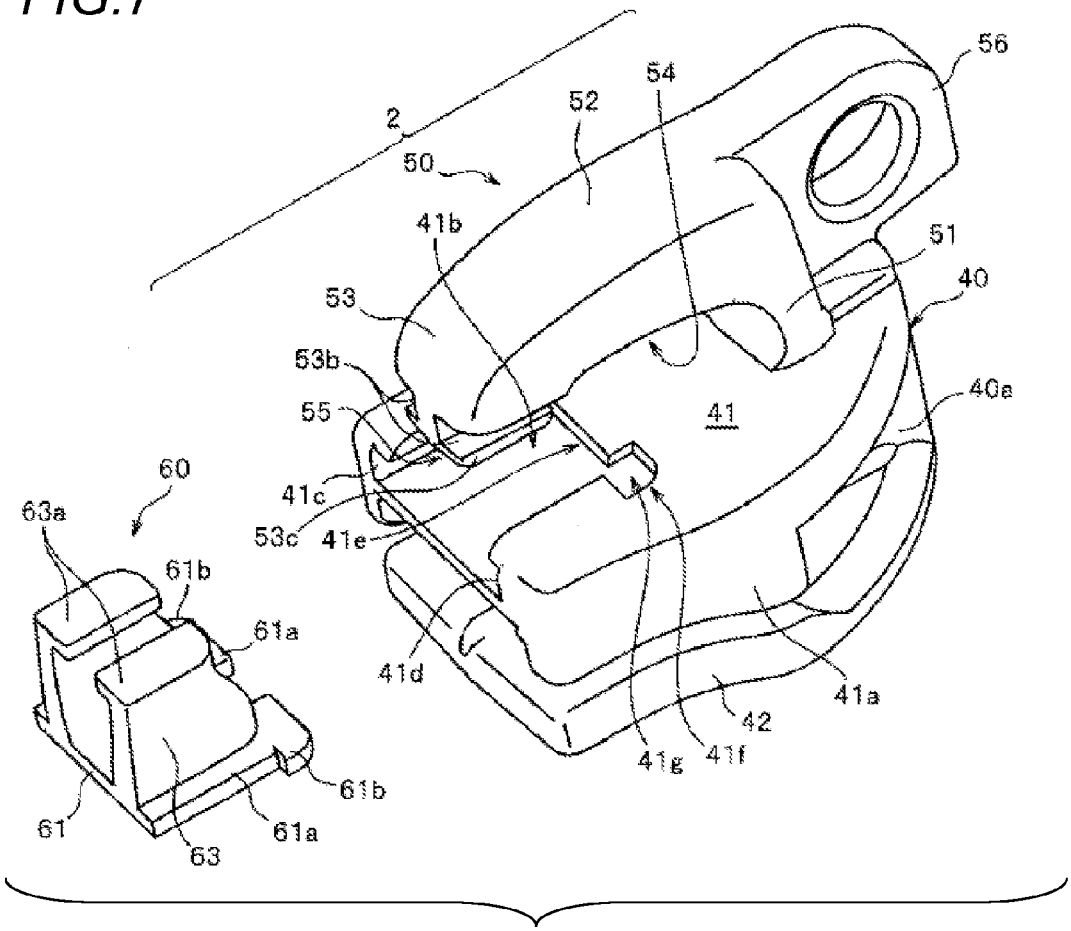
FIG. 7 is an exploded perspective view of a pull tab post-attaching slider for a slide fastener according to an embodiment 2 of the invention.
Figure 8:
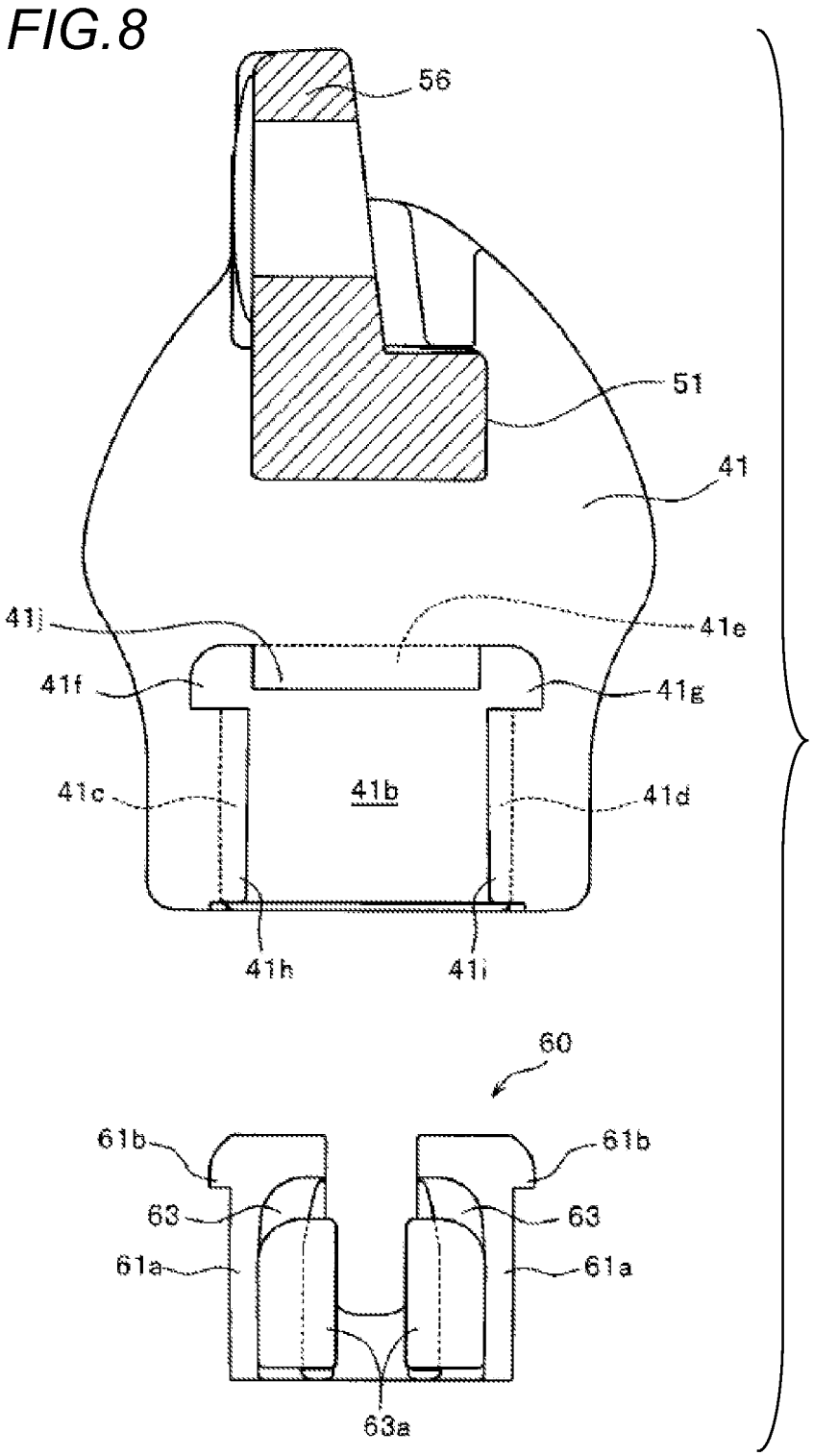
FIG. 8 is a plan view, partially cut showing the slider before a blocking member is mounted thereon.
Figure 9:
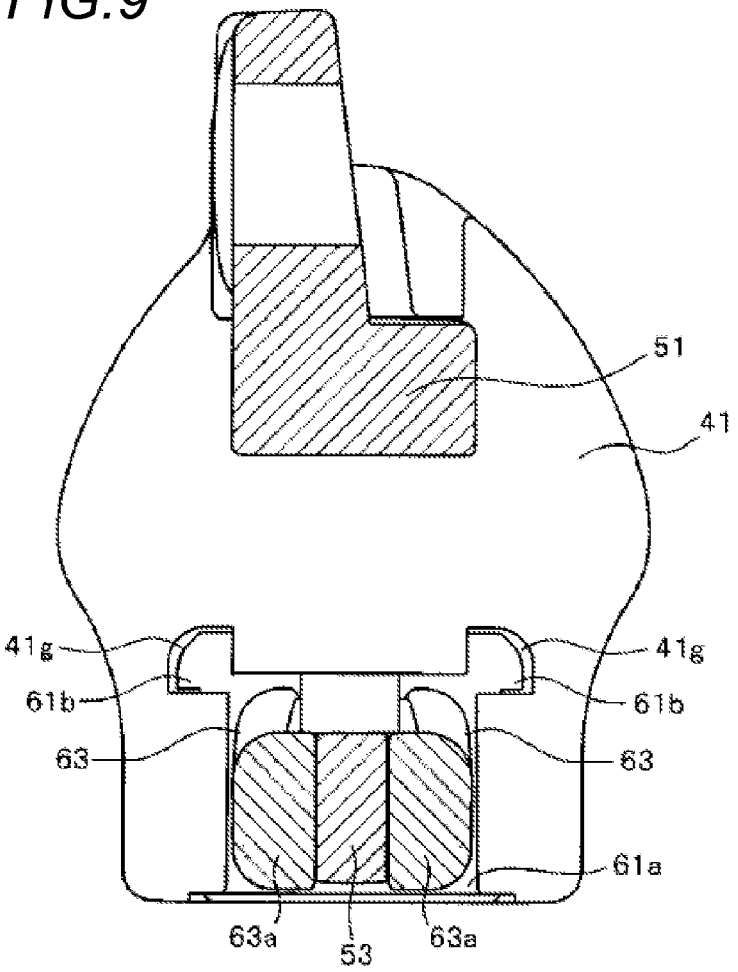
FIG. 9 is a plan view, partially cut, showing the slider after the blocking member is completely mounted thereon.

FIGS. 7 to 10 are views explaining a pull tab post-attaching slider for a slide fastener according to an embodiment 2 of the present invention. FIG. 7 is an exploded perspective view of the slider, FIG. 8 is a top plan view before assembling showing in a state where a fixed end portion of a pull tab attachment rod of the slider is horizontally cut, and FIG. 9 is a top plan view after assembling showing in a state where the fixed end portion of the pull tab attachment rod and erected plate pieces of the blocking member in the slider are horizontally cut. Meanwhile, in the description of the embodiment described below, members or portions having the substantially same configurations and functions as those of the embodiment 1 already described are designated by the same reference numerals and terms, and accordingly, the detailed descriptions thereof will be omitted.

The pull tab post-attaching slider (hereinafter, simply referred to as the slider) 2 for the slide fastener according to the present embodiment 2 includes a slider body 40, a pull tab attachment rod 50 integrally fixed in cantilever fashion on the slider body 40, a blocking member 60 mounted in the slider body 40, and a pull tab 5, not shown, held on the pull tab attachment rod 50. As shown in FIG. 7, the slider body 40 of the slider 2 has upper and lower blades 41 and 42 arranged to be parallel to each other, a guide post 40*a* connecting front end portions of the upper and lower blades 41 and 42 with each other, and right and left flanges 11*a* suspended from right and left edges of the upper blade 41 toward the lower blade 42.

On an upper surface of a rear half of the upper blade 41 in the slider body 40, as shown in FIGS. 7 and 8, a generally rectangular recessed portion 41*b*, which is a first mounting portion of the present invention, is formed and first dovetail groove portions 41*c*-41*e* having a U cross-sectioned wall surface are formed in right and left and rear inner wall surfaces of the recessed portion 41*b*.

Like the first dovetail groove portion 11*c* of the embodiment 1 as described above, the first dovetail groove portions 41*c*-41*e* of the embodiment 2 include first recessed grooves formed along a periphery of the recessed portion 41*b* and protrusion piece portions 41*h*-41*j* arranged above a space portion (interior space) of the first recessed grooves and protruding in a collar shape from positions of groove bottom surfaces of the first recessed grooves toward the recessed portion 41*b*.

Fan-shaped cutout portions 41*f* are continuously formed at right and left corner portions in a front end portion of the recessed portion 41*b*. Positions of outsides of the cutout portions 41*f* in a slider width direction (right and left direct) are positioned more outward in the slider width direction than positions of the groove bottom surfaces of the right and left first dovetail grooves 41*c* and 41*d*, and a groove depth of the front first dovetail groove 41*e* to the bottom surface thereof is formed to be deeper than groove depths of the right and left first dovetail groove portions 41*c* and 41*d*. Meanwhile, the fan-shaped cutout portions 41*f* are formed for the purpose of easily and reliably performing injection molding.

The pull tab attachment rod 50, which is fixedly installed in cantilever fashion on the upper blade 41 of the slider body 40, has a fixed end portion 51 erected from a front end portion of the upper blade 41, an extension portion 52 bent to extend rearward from the fixed end portion 51, and a free end portion 53 formed to be bent from the extension portion 52 toward the upper blade 41. A receiving space 54 for receiving an attachment shaft portion 5*b* of the pull tab 5 is formed between a lower surface of the extension portion 52 of the pull tab attachment rod 50 and the upper surface of the upper blade 41.

Also, as shown in FIG. 7, the free end portion 53 of the pull tab attachment rod 50 has an insertion gap 55 through which the attachment shaft portion 5*b* of the pull tab 5 can be inserted between the free end portion 53 and the upper surface of the upper blade 41. In addition, a pair of right and left second dovetail groove portions 53*b* having a U cross-sectioned wall surface as a second mounting portion are formed to extend through a bent lower end on a rear end side of the free end portion 53 of the pull tab attachment rod 50 in a forward and rearward direction.

Like the second dovetail groove portions 23*a* in the embodiment 1 as described above, the second dovetail groove portions 53*b* of the present embodiment 2 include a pair of second recessed grooves provided to be recessed from the right and left side surfaces of the free end portion 53 inward in the slider width direction, and a pair of ridge portions 53*c* arranged below a space portion (interior space) of each of the second recessed grooves and protruding from positions of the bottom surfaces of the second recessed grooves outward in the slider width direction. Meanwhile, like the embodiment 1 as described above, the slider 2 of the embodiment 2 has a locking member 56 as shown in FIGS. 7 and 8.

As shown in FIGS. 7 and 8, the blocking member 60 of the present embodiment 2 includes a U-shaped horizontal base plate 61 fitted into the first dovetail groove portion 41*c* of the upper blade 41, a pair of right and left erected plate pieces 63 erected to extend from a rear end portion to a front side portion of the horizontal base plate 61 in parallel to each other, and right and left blade pieces 63*a* horizontally extending from an upper end of each erected plate piece 63 in directions approaching to each other.

The present embodiment 2 has two differences from the embodiment 1, and one thereof is that in the embodiment 1, the right and left locking claws 33*b* configured to be fitted into the right and left second dovetail groove portions 23*a*, which is formed in the free end portion 23 of the pull tab attachment rod 20, and thus to be locked in the front end locking spaces 23*b*, protrude inward from the blade pieces 33*a* on the upper ends of the erected plate pieces 33, whereas in the embodiment 2, right and left locking claws 61*b* do not protrude from upper ends of the erected plate pieces 63, but protrude horizontally in outward directions away from each other from front end portions of right and left flat plate portions 61*a* of the U-shaped horizontal base plate 61, which extend horizontally in parallel to each other in the forward direction and also outward in the right and left direction.

Also, a second difference is that as described above, because locking claws are not formed on the right and left blade pieces 63 as the second mounted portion formed on the upper ends of the erected plate pieces 63, locking spaces, in which locking claws are to be locked, are not also formed in the front end portions of the second dovetail groove portions 53*b* as the second mounting portion, which are formed in the free end portion 53 of the pull tab attachment rod 50 to allow the right and left blade pieces 63*a* to be fitted therein.

In order to mount the blocking member 60 on the slider body 40 and the pull tab attachment rod 50, the attachment shaft rod 5*b* of the pull tab 5 is inserted through the pull tab insertion gap 55 between the upper blade 41 of the slider body 40 and the free end portion 53 of the pull tab attachment rod 50 to be received and held in the receiving space 4 formed between the extension portion 52 of the pull tab attachment rod 50 and the upper surface of the upper blade 41. Then, as shown in FIG. 8, the right and left locking claws 61*b* formed on the leading end portion of the right and left flat-plate portions 61*a* of the U-shaped horizontal base plate 61 of the blocking member 60 are first arranged to face the right and left first dovetail groove portions 41*c* and 41*d* formed in the upper blade 41 of the slider body 40. Then, the locking claws 61*b* are respectively fitted into the first dovetail groove portions 41*c* and 41*d*.

Herein, a shape of the locking claws 61*b* is formed in a fan shape to have a shape corresponding to the fan-shaped cutout portions 41*f* formed in the upper blade 41. Space portions formed between height positions of the cutout portions 41*f* and a height position of the bottom of the recessed portion 41*b* constitutes locking spaces 41*g*, in which the locking claws 61*b* are to be locked. Also, a distance between right and left edges of the right and left locking claws 61*b* (distance between end edges in the width direction) is configured to be larger than a dimension between groove bottoms of the right and left dovetail groove portions 41*c* and 41*d* of the upper blade 41. Meanwhile, the U-shaped horizontal base plate 61, the right and left flat plate portions 61*a*, which extend horizontally in the forward direction and outward in the right and left direction from the horizontal base plate 61, and the erected plate pieces 63 can be elastically deformed in the right and left direction, and thus a distance between front end portions (leading end portions) of the horizontal base plate 61 in the right and left direction can be expanded and contracted.

Figure 10:
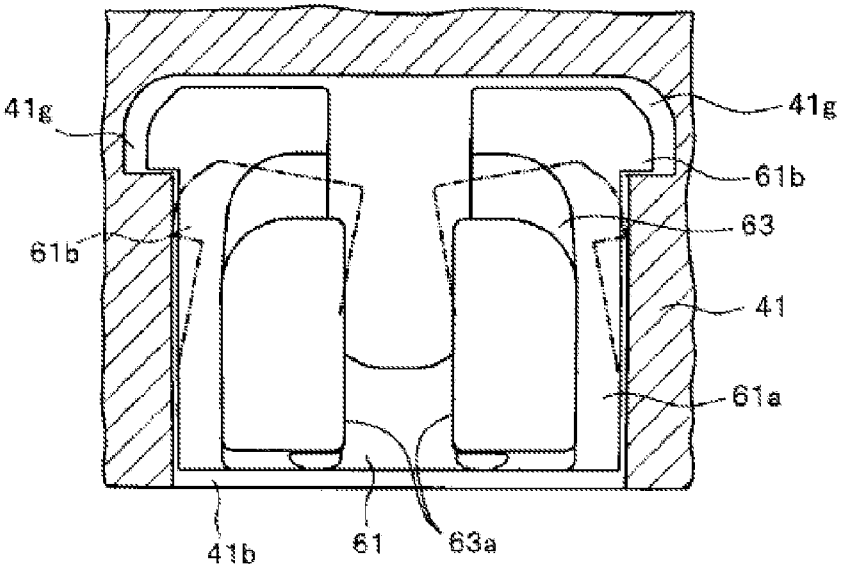
FIG. 10 is a view explaining a behavior of a locking claw when the blocking member is locked on a slider body.

Accordingly, when the pair of right and left locking claws 61*b* are fitted into the first dovetail groove portions 41*c* and 41*d* of the recessed portion 41*b*, protrusion ends of the locking claws 61*b* interfere respectively with the groove bottoms of the first dovetail groove portions 41*c* and 41*d* in an initial stage, but arc-shaped surfaces of the locking claws 61*b* are guided by the groove bottoms so that as shown by a phantom line in FIG. 10, the horizontal base plate 61 and the right and left flat plate portions 61*a* are subject to pushing forces laterally exerted in directions approaching to each other (inward direction) and thus are pushed in forward from the elastically deformed state.

When the pushing operation is continued so that the right and left locking claws 61*b* reach positions of the locking spaces 41*g* formed below the right and left fan-shaped cutout portions 41*f*, the pushing forces laterally exerted by the groove bottoms of the first dovetail groove portions 41*c* and 41*d* are released and accordingly, as shown in FIGS. 9 and 10, the right and left locking claws 61*b* together with the U-shaped horizontal base plate 61, the flat plate portions 61*a* and the erected plate pieces 63 are elastically returned to an original state to be locked on locking surfaces of the right and left locking spaces 41*g*, and at the same time, front end portions of the right and left flat plate portions 61*a* and front end portions of right and left fan-shaped locking claws 61*b* are fitted into the front first dovetail groove portion 41*e*. Thus, the blocking member 60 reliably stops movement in the upward and downward direction and the right and left direction and also retracting movement.

As described above, like the embodiment 1, the slider 2 of the present embodiment 2 has a simple structure and the pull tab 5 can be easily attached afterward to the slider body 40 without performing cumbersome works such as crimping. Accordingly, for example, when sets of the slider body 40, the blocking member 60 and various types of pull tabs 5 are delivered to clothes or bag makers, clothes or bag makers can easily perform an assembling operation and thus a pull tab 5 having a desired design can be selected and freely attached to the slider body 40.

In addition, according to the slider 2 of the present embodiment 3, because the free end portion 53 of the pull tab attachment rod 50 and the upper blade 41 of the slider body 40 can be strongly fixed via the blocking member 60, even if a strong force directed obliquely forward and upward is exerted on the pull tab 5, the blocking member 60 are coupled in dovetail grooves formed in the upper blade 41 of the slider body 40 and the free end portion 53 of the pull tab attachment rod 50, thereby reliably preventing movement of the blocking member 60 in the upward and downward direction and the right and left direction.

Also, at the same time, the blocking member 60 can be prevented from being moved rearward due to locking between the fan-shaped locking claws 61*b*, which protrude from the front end portions of the right and left flat plat portions 61*a* of the horizontal base plate 61 of the blocking member 60 outward in the right and left direction, and the locking surfaces of the locking spaces 41*g*, which are formed in the upper blade 41 (locking surface arranged on leading ends of the right and left dovetail groove portions 41*c* and 41*d*).

Embodiment 3

Figure 11:
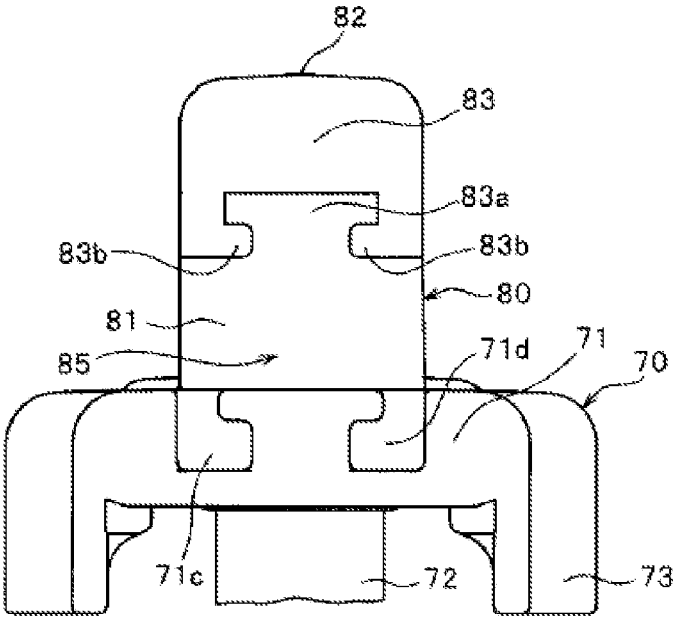
FIG. 11 is a rear view, partially omitted, showing of a pull tab post-attaching slider for a slide fastener according to an embodiment 3 of the invention, as viewed from the rear thereof.
Figure 12:
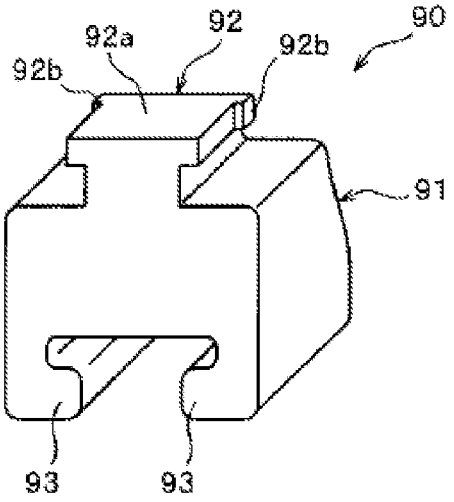
FIG. 12 is a perspective view of a blocking member of the slider as viewed from the upper rear thereof.
Figure 13:
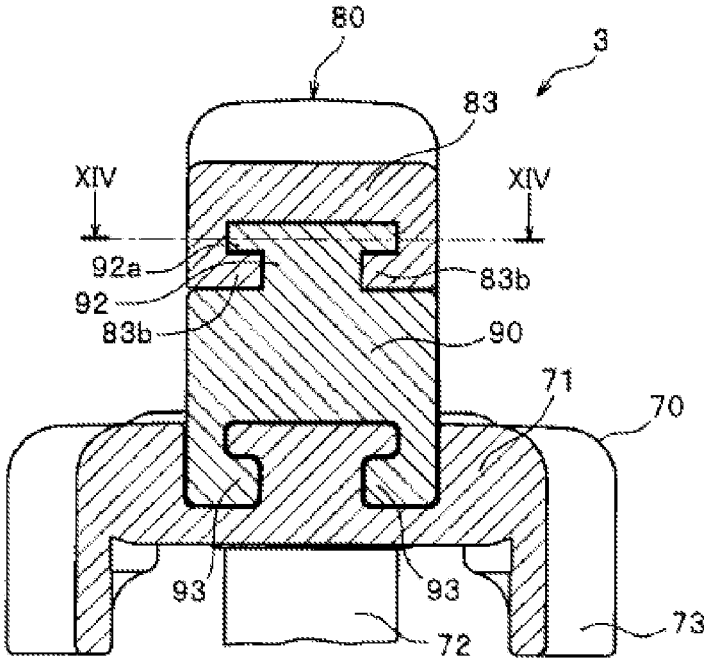
FIG. 13 is a cross-sectional view of a blocking member mounting portion of the slider after the blocking member is mounted thereon.
Figure 14:
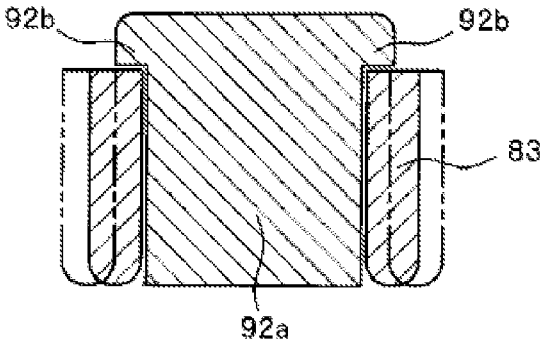
FIG. 14 is a view explaining an operation of fitting the blocking member of the slider into a T cross-sectioned dovetail groove portion in a pull tab attachment rod thereof.

FIGS. 11 to 14 are views explaining a pull tab post-attaching slider for a slide fastener according to an embodiment 3. In these figures, a lower bladed of the slider is omitted. FIG. 11 is a rear view showing a slider body of the slider and a pull tab attachment rod fixedly installed on the slider body as viewed from the rear mouth side thereof, FIG. 12 is a perspective view showing a blocking member as obliquely viewed from the rear upper side, FIG. 13 is a partial cross-sectional view of the slider having the blocking member mounted on the slider body and the pull tab attachment rod, and FIG. 14 is an explanatory view explaining an fitting operation of the blocking member using a section taken along a XIV-XIV line of FIG. 13 as viewed in an arrow direction therein.

Referring to FIG. 13, the pull tab post-attaching slider (hereinafter, simply referred to as the slider) 3 for the slide fastener according to the present embodiment 3 includes a slider body 70, a pull tab attachment rod 80 integrally fixedly installed in cantilever fashion on one end of an upper blade 71 of the slider body 70, a blocking member 90 mounted between the upper blade 71 of the slider body 70 and a free end portion 83 of the pull tab attachment rod 80 and adapted to prevent movement in the upward and downward direction and the right and left direction, and a pull tab 5, not shown.

The slider body 70 of the slider 3 has an upper blade 71 and a lower blade, not shown, arranged to be generally parallel to each other, a guide post 72 connecting front end portions of the upper and lower blades with each other, and right and left flanges 73 suspended from right and left edges of the upper blade 71 toward the lower blade. On an upper surface of a rear end surface of the upper blade 71 of the slider body 70, as shown in FIG. 11, a pair of right and left first dovetail groove portions 71*c* and 71*d* extending forward in parallel to each other and having respectively a L cross-section and an inverted L cross-section as viewed from the rear mouth side are formed with a predetermined distance therebetween. Meanwhile, the pull tab attachment rod 80 has a fixed end portion 81 erected from a front end portion of the upper blade 71, an extension portion 82 bent to extend rearward from the fixed end portion 81, and a free end portion 83 formed to be bent from the extension portion 82 toward the upper surface of the upper blade 71. As shown in FIG. 11, a T cross-sectioned second dovetail groove portion 83*a* is also formed to extend through the middle of a lower half of the free end portion 83 in the forward and rearward direction. In the embodiment 3, the pair of right and left dovetail groove portions 71*c* and 71*d* formed in the upper blade 71 is a first mounting portion and the T cross-sectioned second dovetail groove portion 83*a* formed in the pull tab attachment rod 80 is a second mounting portion.

As shown in FIG. 12, the blocking member 90 has a block-like body 91 formed in a rectangular parallelepiped shape and an erected portion 92 erected upward from the middle of an upper surface of the block-like body 91 and having a T cross-section extending outward in the right and left direction. The T cross-sectioned erected portion 92 is formed to extend from a front end to a rear end of the block-like body 91 and includes a base portion having a predetermined width dimension and an upper flat plate portion 92*a* arranged over the base portion and having a width dimension larger than that of the base portion.

Also, on front end side surfaces of the upper flat plate portion 92*a* of the erected portion 92, right and left locking claws 92*b* are arranged to protrude outward in a width direction thereof. Because a T cross-sectioned space portion is formed in the middle of a lower end of the block-like body 91, right and left fitting portions 93 are arranged to be fitted into the pair of right and left first dovetail groove portions 71*c* and 71*d* with the L cross-section and the inverted L cross-section, respectively, of the upper blade 71. In the present embodiment 3, the T cross-sectioned erected portion 92 of the blocking member 90 confronts a second mounted portion and the pair of right and left fitting portions 93 confront a first mounted portion.

In order to assembly the slider 3 of the present embodiment 3 comprised of components as described above, as shown in FIG. 2, the attachment shaft portion 5*b* of the pull tab 5 is first inserted through a pull tab insertion gap 85 between the free end portion 83 of the pull tab attachment rod 80 and the upper surface of the upper blade 71 to be received and held in a pull tab receiving space between the extension portion 82 of the pull tab attachment rod 80 and the upper surface of the upper blade 71. Herein, to fixedly mount the blocking member 90 in the pull tab insertion gap 85 between the free end portion 83 of the pull tab attachment rod 80 and the upper surface of the upper blade 71, the T cross-sectioned erected portion 92 (second mounted portion) of the blocking member 90 is arranged to face the T cross-sectioned second dovetail groove portion 83*a* (second mounting portion) formed in the free end portion 83 of the pull tab attachment rod 80, and also the pair of right and left fitting portions 93 (first mounted portion) arranged on the lower end portion of the block-like body 91 of the blocking member 90 is arranged to face the pair of right and left first dovetail groove portions 71*c* and 71*d* (first mounting portion) with the L cross-section and the inverted L cross-section, respectively, formed in the upper blade 71.

Then, the blocking member 90 is advanced so that the fitting portions 93 and 93 confront the pair of right and left first dovetail groove portions 71*c* and 71*d* (first mounting portion) with the L cross-section and the inverted L cross-section and also the front end portions of the upper flat plate portion 92*a* and the right and left locking claws 92*b* of the T cross-sectioned erected portion 92, as the second mounted portion, of the blocking member 90 confront the T cross-sectioned second dovetail groove portion 83*a* of the pull tab attachment rod 80. Subsequently, the blocking member 90 is fitted into grooves of the first dovetail groove portions 71*c* and 71*d* and the second dovetail groove portion 83*a* and then is and slidingly advanced therein.

At this time, as shown by a phantom line FIG. 14, right and left edge portions (ridge portions) 83*b* of an opening end of the T cross-sectioned second dovetail groove portion 83*a* of the free end portion 83 of the pull tab attachment rod 80 are subject to pushing forces, which are exerted outward in the right and left direction from the inside, to be elastically deformed outward, thereby allows the locking claws 92*b* to be guided forward. When leading ends of the locking claws 92*b* protrude forward beyond a terminating end surface at an inner portion of the second dovetail groove portion 83*a* in the free end portion 83 of the pull tab attachment rod 80, as shown by a solid line in FIG. 14, the right and left edge portions 83*b* of the free end portion 83 enter below the upper flat plate portion 92*a* and thus are elastically returned to an original state as the pushing forces are released. Thus, a distance between the right and left edge portions 83*b* of the free end portion 83 in the right and left direction is contracted and at the same time the locking claws 92*b* are locked on the terminating end surface of the inner portion of the second dovetail groove portion 83*a*, and as a result, assembling is ended.

According to the slider 3 of the present embodiment 3, despite a very simple structure and an easy assembling operation thereof as described above, movement of the blocking member 90 relative to the slider body 70 and the pull tab attachment rod 80 in the upward and downward direction and the right and left direction can be reliably inhibited due to coupling of the blocking member 90 to the first dovetail groove portions 71*c* and 71*d* and the second dovetail groove portion 83*a* and also retracting movement of the blocking member 90 can be prevented due to the locking claws 92*b*. Accordingly, the blocking member 90 is not separated from the slider body 70 and even if a strong force is exerted on the pull tab, a large deformation is not caused on the pull tab.

In addition, according to the slider 3 of the embodiment 3, the first mounting portion provided in the upper blade 71 is comprised of the pair of right and left first dovetail groove portions 71*c* and 71*d* and the second mounting portion provided in the pull tab attachment rod 80 is comprised of the T cross-sectioned second dovetail groove portion 83*a*. However, in the slider 3, for example, it can be also said that the first mounting portion provided in the upper blade 71 is comprised of a T cross-sectioned protrusion arranged between the right and left first dovetail groove portions 71*c* and 71*d* and the first mounted portion of the blocking member 90 to be mounted on the first mounting portion is comprised of the T cross-sectioned space portion (dovetail groove portion) formed in the middle of the lower end portion of the block-like body 91.

Similarly, it can be also said that the second mounting portion provided in the free end portion 83 of the pull tab attachment rod 80 is comprised of the right and left edge portions 83*b* arranged on right and left sides of the second dovetail groove portion 83*a* and the second mounted portion of the mounting member 90 to be mounted on the second mounting portion is comprised of a recessed groove-shaped space portion (dovetail groove portion) formed between the block-like body 91 and the upper flat plate portion 92*a* of the erected portion 92.

Embodiment 4

Figure 15:
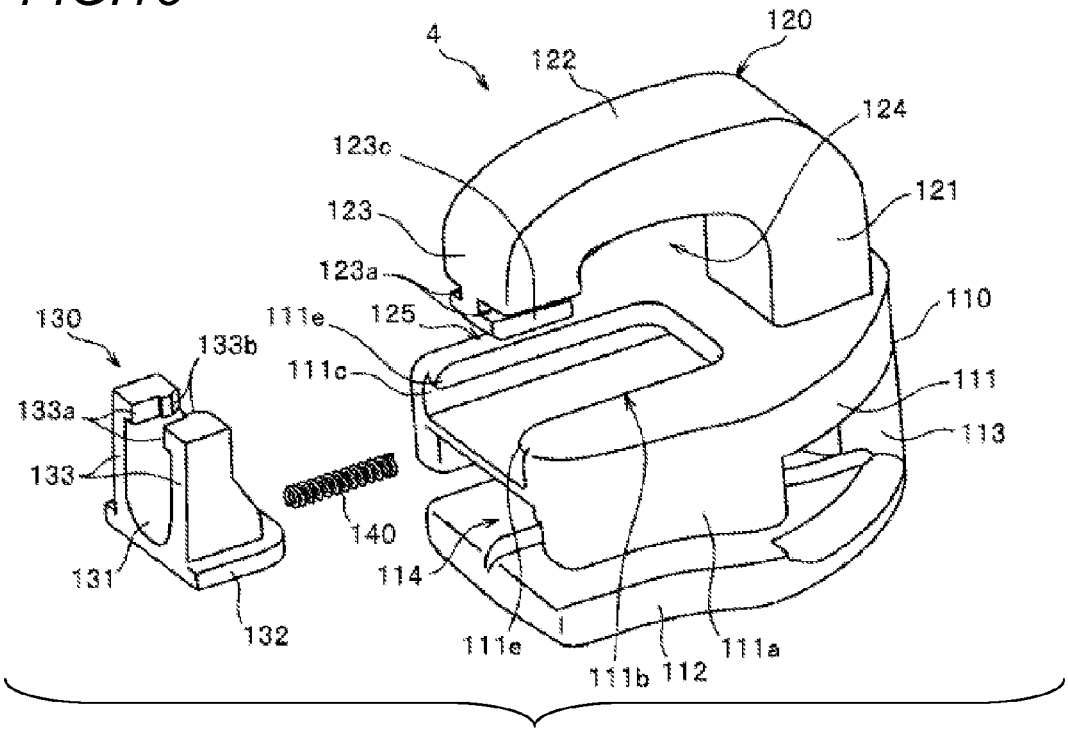
FIG. 15 is an exploded perspective view of a pull tab post-attaching slider for a slide fastener according to an embodiment 4 of the invention.
Figure 16:
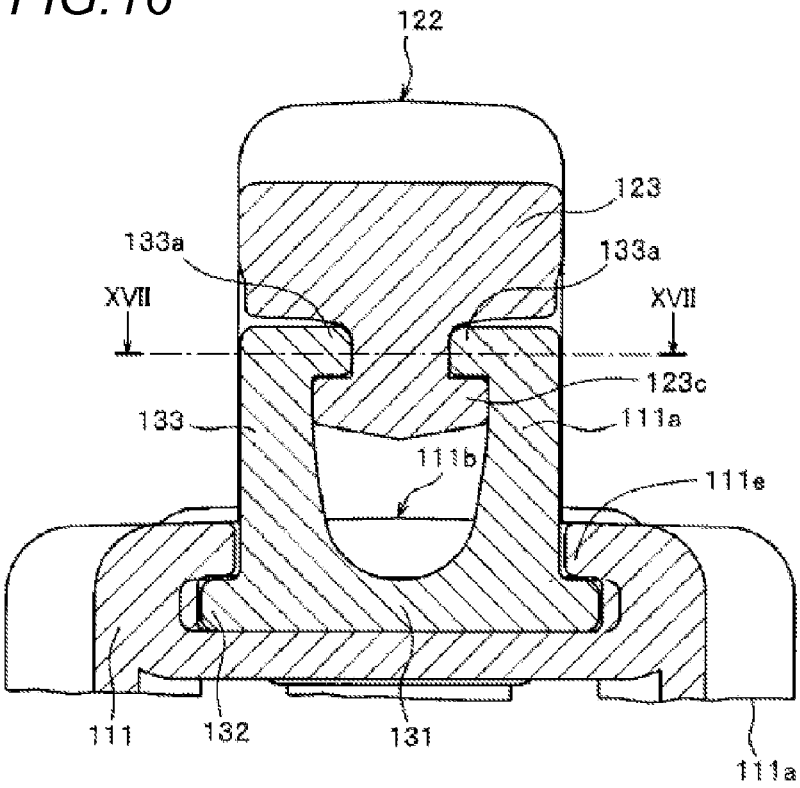
FIG. 16 is a cross-sectional view of a blocking member mounting portion of the slider after a blocking member is mounted thereon.
Figure 17:
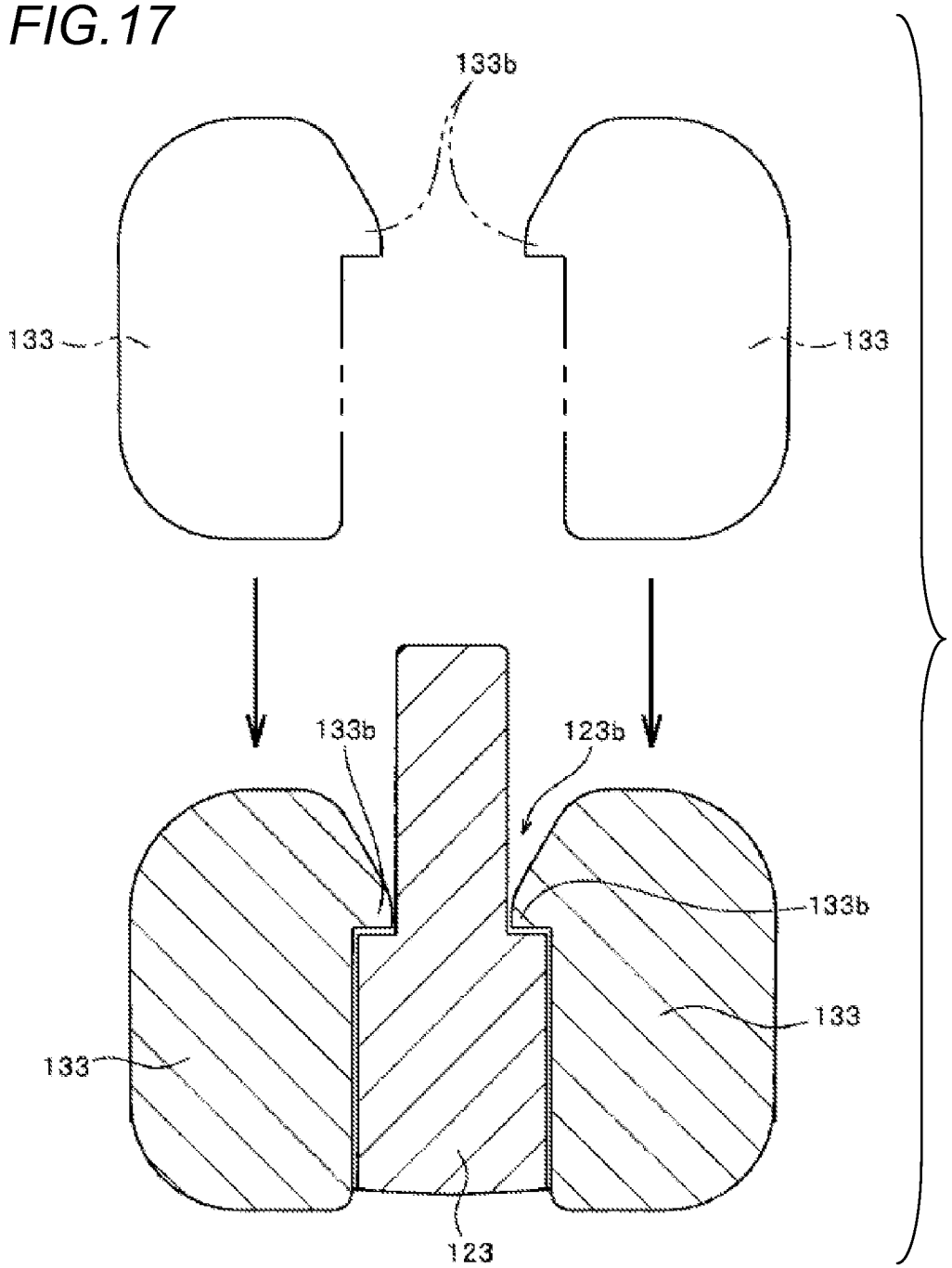
FIG. 17 is a view explaining a behavior of the blocking member when the blocking member, which has been advanced into a pull tab receiving space in front of the mounting portion, is returned to the mounting portion.
Figure 18:
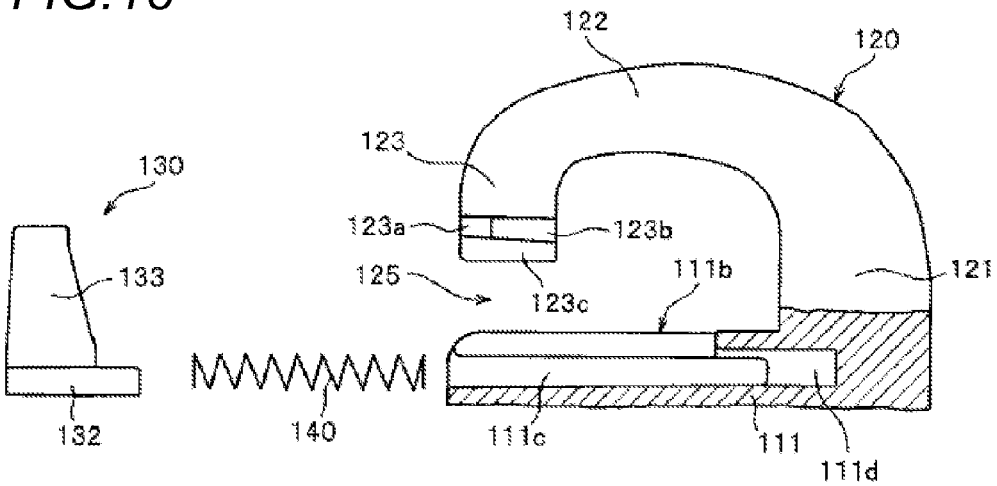
FIG. 18 is a side view, partially cutaway, showing the slider before a blocking member is mounted thereon.
Figure 19:
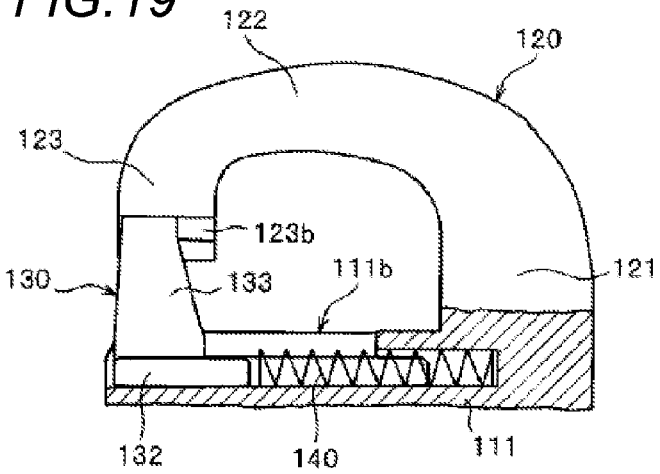
FIG. 19 is a side view, partially cutaway, showing the slider after the blocking member is completely mounted thereon.
Figure 20:
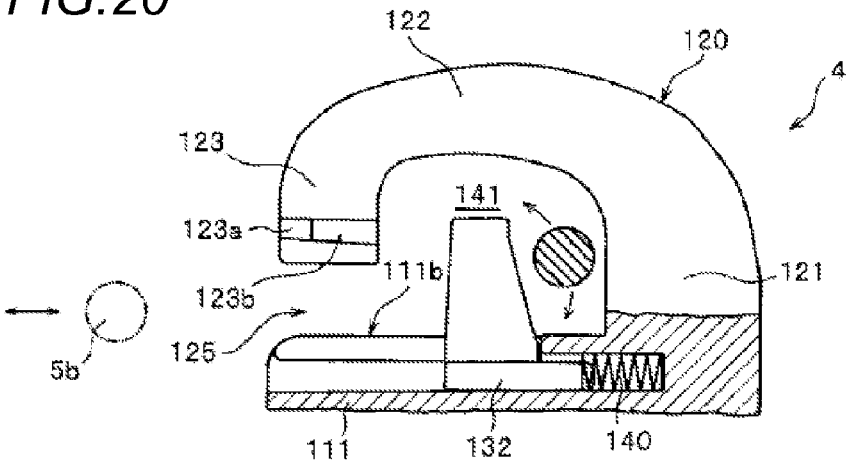
FIG. 20 is a view explaining procedures for attaching and detaching a pull tab after the blocking member is mounted.

FIGS. 15 to 20 relates to a pull tab post-attaching slider (hereinafter, simply referred to as a slider) for a slider fastener according to an embodiment 4 of the present embodiment, in which FIG. 15 is an exploded perspective view of the slider, FIG. 16 is a cross-sectional view of the slider after assembling, FIG. 17 is a view taken along a line XVII-XVII of FIG. 16 as viewed in an arrow direction therein, and FIGS. 18 to 20 are views explaining assembling of the slider.

The slider 4 of the present embodiment 4 includes a slider body 110, a pull tab attachment rod 120 integrally formed in cantilever fashion on the slider body 110, a blocking member 130 mounted in a pull tab insertion gap 125 between an upper surface of the slider body 110 and a free end portion 123 of the pull tab attachment rod 120, a coil spring 140 mounted between the blocking member 130 and the slider body 110, and a pull tab, not shown, held on the pull tab attachment rod 120. The pull tab has the substantially same structure as that of the embodiment 1, but the slider 4 of the embodiment 4 is different from the embodiment 1 in that as shown in FIG. 15 the coil spring 140 is mounted between the blocking member 130 and an upper blade 111 and also in that the slider 4 is a general pull tab post-attaching slider in which a locking member is not provided on a front end portion of the pull tab attachment rod 120.

Referring to FIGS. 15 and 18, the slider body 110 has upper and lower blades 111 and 112 arranged to be generally parallel to each other, a guide post 113 connecting front end portions of the upper and lower blades 111 and 112 with each other with a predetermined distance therebetween, and a pair of right and left flanges 111*a* suspended from right and left edges of the upper blade 111 toward the lower blade 112. Shoulder mouths are formed on right and left sides of a front portion of the slider body 110 with the guide post 113 interposed therebetween, and a rear mouth is formed in a rear end of the slider body 110. Also, a Y-shaped element guide path 114 for communicating the right and left shoulder mouths with one rear mouths is formed between the upper and lower blades 111 and 112.

Also, on an upper surface of the upper blade 111 of the slider body 110, a rectangular recessed portion 111*b* constituting a first mounting portion, in which the blocking member 130 can be mounted, is formed to extend forward from a rear end (rear mouth-side edge end) of the upper blade 111. The rectangular recessed portion 111*b* has a bottom surface parallel to the upper surface of the upper blade 111 and also serves as a part of a first mounting portion for mounting the blocking member 30 according to the present invention. The rectangular recessed portion 111*b* has a long side portion (length in the forward and rearward direction) set to be longer than that of the recessed portion 11*b* of the embodiment 1 as described above and extends to the vicinity of the guide post 113.

A first dovetail groove portion 111*c* having a U-shaped continuous wall surface opened at a front side thereof is formed in right and left wall surfaces of the rectangular recessed portion 111*b* and a front wall surface in a depth direction thereof. In an inner wall surface (groove bottom surface), as shown in FIG. 18, a bottomed spring insertion hole 111*d* is formed to extend up to approximately a half of a length of the guide post 113 in the forward and rear direction.

In the embodiment 4, the first dovetail groove portion 111*c* includes a first recessed groove formed along a periphery of the rectangular recessed portion 111*b* and a protrusion piece portion 111*e* arranged above a space portion (interior space) of the first recessed grooves and protruding in a collar shape from a position of a groove bottom surface of the first recessed groove toward the recessed portion 111*b*.

The pull tab attachment rod 120 has a fixed end portion 121 erected from the front end portion of the upper blade 111, an extension portion 122 bent to extend rearward from the fixed end portion 121, and a free end portion 123 bent downward from the extension portion 122 toward the upper surface of the upper blade 111. A receiving space 54 for receiving an attachment shaft portion 5*b* of the pull tab 5 is formed between a lower surface of the extension portion 52 of the pull tab attachment rod 50 and the upper surface of the upper blade 41. In the present embodiment 4, also, the fixed end portion 121 of the pull tab attachment rod 120 is integrally molded on the upper surface of the upper blade 111 at the same time as molding of the slider body 110. Also, the pull tab attachment rod 120 according to the embodiment 4 is generally of a downward horizontal C-shape as viewed from the side, and a receiving space 124 for receiving and holding an attachment shaft portion of the pull tab, not shown, is formed between a lower surface of the extension portion 122 of the pull tab attachment rod 120 and the upper surface of the upper blade 111.

As shown in FIG. 15, the free end portion 123 of the pull tab attachment rod 120 has an insertion gap 125 through which the attachment shaft portion 5*b* of the pull tab 5 can be inserted between the free end portion 123 and the upper surface of the upper blade 111. Also, on right and left side surfaces of the free end portion 123 of the pull tab attachment rod 120, second dovetail groove portions 123*a* extending in the forward and rearward direction are formed to be recessed inward in a slider width direction.

The second dovetail groove portions 123*a* include a pair of second recessed grooves provided to be recessed from the right and left side surfaces of the free end portion 123 inward in the slider width direction and ridge portions 123*c* arranged respectively below a space portion (interior space) of each of the second recessed grooves and protruding from positions of the bottom surfaces of the pair of second recessed grooves outward in the slider width direction.

Also, as shown in FIG. 18, the second dovetail groove portions 123*a* according to the present embodiment 4 are formed to be slightly inclined downward toward the guide post 113 relative to the upper surface of the upper blade 11. Due to such a downward inclination, the blocking member 130 is further difficult to be slid down rearward because right and left blade pieces 133*a*, as described below, of the blocking member 130 are mounted in a forward inclined posture after the blocking member 130 is fixedly mounted in the insertion gap 125.

According to the present embodiment 4, right and left end edges (groove bottom surfaces) of leading end-side half regions of the second dovetail groove portions 123*a* are cut-out inward as shown in FIG. 17 so that groove depths of the second dovetail groove portions 123*a* are increased, thereby constructing locking spaces 123*b* for stably locking the locking claws 133*b* of the blocking member 130 as described below. The second dovetail groove portions 123*a* and the locking spaces 123*b* are a part of a second mounting portion, into which the right and left blade pieces 133, as described below, of the blocking member 130 are fitted.

In addition, ridges on rear opening ends of the second dovetail groove portions 123*a* of the free end portion 123 of the pull tab attachment rod 120 and the first dovetail groove portion 111*c* of the recessed fitting portion 111*b* formed in the upper blade 111 are chamfered. Thus, when a part of the blocking member 130 is inserted into the first dovetail groove portion 111*c* and the second dovetail groove portions 123*a*, the inserting operation can be facilitated, and also when the blocking member 130 is inserted into the recessed fitting portion 111*b* of the upper blade 111, right and left erected plate portions 133, as described below, formed on an upper end of the blocking member 30, can be easily elastically deformed in a horizontal direction (in particular, the slider width direction).

The blocking member 130 according to the present embodiment 4 includes a rectangular base plate portion 131 fitted into and mounted on and fitted into the first dovetail groove portion 111*c* formed in the inner wall surface of the recessed fitting portion 111*b* of the upper blade 111, a U-shaped flange-like plate piece 132 continuously extending in parallel from right and left side edges and a front end edge of the base plate portion 131 outward in three directions, a pair of erected plate pieces 133 erected in parallel from right and left end edges of an upper surfaces of the base plate portion 131 to be parallel to each other, right and left blade pieces 133*a* extending from inner surfaces of upper ends of the erected plate pieces 133 to face each other, and locking claws 133*b* protruding toward opposing side surface of front end portions of the right and left blade pieces 133*a*. Herein, the right and left erected plate pieces 133 can be elastically deformed in the right and left direction.

In order to assembly the slider 4 of the present invention using components as described above, the coil spring 140 arranged between the rear end of the upper blade 111 and the front end of the blocking member 130 is inserted and received in the spring insertion hole 111*d* formed in the first dovetail groove portion 111*c* on the front side of the recessed portion 111*b* of the upper blade 111.

Then, a leading end of the flange-like plate piece 132 extending forward from the front end of the base plate portion 131 of the blocking member 130 is bumped against a rear end of the coil spring 140 to compress the coil spring 140. Also, the flange-like plate pieces 132 of the blocking member 130 are inserted into the right and left first dovetail groove portion 111*c* formed in the upper blade 111 of the slider body 110, and at the same time the locking claws 133*b* of the right and left blade pieces 133*a* of the blocking member 130 are inserted into the second dovetail groove portions 123*a* formed in the free end portion 123 of the pull tab attachment rod 120, and then the blocking member 130 is advanced. During advancing, the locking claws 133*b* protruding inward from the upper ends of the erected plate pieces 133 are pushed by the groove bottom surfaces of the second dovetail groove portions 123*a* to be expanded outward in the right and left direction. When the blocking member 130 reaches halves of the locking spaces 123*b* of the second dovetail groove portions 123*a*, as shown in FIG. 19, a force exerted to push and expand the erected plate pieces 133 are released, and thus the erected plate pieces 133 are elastically returned to an original state so that the right and left locking claws 133*b* are respectively locked in the locking spaces 123*b*, thereby ending assembling.

At this time, the coil spring 140 is in a compressed state to urge the blocking member 130 rearward. In this state, the blocking member 130 is further moved forward along the bottom surface of the recessed portion 111*b* against an urging force of the coil spring 140, and then as shown in FIG. 20, is stopped below the extension portion 122 of the pull tab attachment 120. In this state, the pull tab insertion gap 125 is again formed between the free end portion 123 of the pull tab attachment rod 120 and the upper surface of the upper blade 111, and at the same time a passage space 141 through which the attachment shaft portion 5*b* of the pull tab 5 passes are formed between a periphery of the blocking member 130 and the lower surface of the extension portion 122.

Thus, according to the present embodiment 4, in order to attach the pull tab 5, as shown in FIG. 20, the blocking member 130 is moved forward to be located below the extension portion 122 of the pull tab attachment rod 120, and then the attachment shaft portion 5*b* of the pull tab, not shown, is inserted through the pull tab insertion gap 125 and then inserted into the receiving space 124 through the passage space 141 for the attachment shaft portion 5*b* formed between the extension portion 122 and the periphery of the blocking member 130.

Then, when the compressing force exerted on the coil spring 140 by the blocking member 130 is released, the coil spring 140 is stretched and attempts to return the blocking member 130 to the first and second mounting portion, but the locking claws 133*b* are locked on the locking surfaces of the locking spaces 123*b* formed in the second dovetail groove portions 123*a* of the pull tab attachment rod 120 and thus the blocking member 130 are stopped. Thus, attaching of the pull tab is ended.

According to the present embodiment 4, as described above, the attachment shaft portion 5*b* of the pull tab 5 is attached after the blocking member 130 are temporarily mounted in the pull tab insertion gap 125 between the free end portion 123 of the pull tab attachment rod 120 and the upper surface of the upper blade 11 via the first and second mounting portions against the elastic force of the coil spring and then the blocking member 130 are moved forward, but like the embodiment 1, the pull tab 5 may be first attached during assembling of the slider 4 and then the blocking member 130 may be attached to the first and second mounting portions. Due to this structure, the slider 4 of the embodiment 4 is configured so that the pull tab 5 can be separated through the pull tab insertion space 141 formed between the pull tab attachment rod 120 and the upper blade 111 by performing operations in reverse order from the order of attaching the pull tab as described above.

In the slider 4 assembled as described above, by only inserting and pushing the U-shaped flange-like plate piece 132 extending from the base plate portion 131 of the blocking member 130, which is the first mounted portion, and the right and left blade pieces 133*a* and locking claws 133*b* formed on the upper ends of the erected pieces, which are the second mounted portion of the blocking member 130, into the first dovetail groove portion 111*c* of the recessed fitting portion 111*b*, which is the first mounting portion arranged on the slider body 110, and the second dovetail groove portions 123*a* and the locking spaces 123*b* of the claw locking portion, which are the second mounting portion arranged on the pull tab attachment rod 120, against the urging force of the coil spring 140, the fitting portions of the blocking member 130 can be strongly inserted and also the locking claws 133*b* can locked in the locking spaces 123*b*, thereby automatically and simply achieving coupling of the blocking member 130 to the slider body 110 and the pull tab attachment rod 130.

Due to such coupling, movement of the blocking member 130 relative to the slider body 110 and the pull tab attachment rod 120 in the upward and downward direction and the right and direction as well as in a retracting direction can be reliably prevented so that even if a strong tensile force directed obliquely upward is exerted on the pull tab 5, a large deformation or a damage of the pull tab 5 can be effectively reduced. Also, according to the present embodiment 4, the coil spring 140 is mounted in a compressed state between the blocking member 130 and the first dovetail groove portion 111*c* of the upper blade 111 and thus always urges the blocking member 130 rearward.

Thus, for example, when operations is performed in reverse order from that of operations upon attaching of the pull tab as described above, as shown by a phantom line in FIG. 17, the blocking member 130 can be moved forward from the first and second mounting portions against the urging force of the coil spring 140 and then the pull tab 5 can be separated from the insertion gap 125 between the free end portion 123 of the pull tab attachment rod 120 and the upper blade 111 through the insertion space 141 formed between the extension 122 of the pull tab attachment rod 120 and the periphery of the blocking member 130, thereby allowing substitution with a desired pull tab. After the pull tab 5 is separated from the insertion gap 125, as shown by a solid line in FIG. 17, the blocking member 130 is returned to the original position relative to the first and second mounting portion by the elastic force of the coil spring.

Because main coupling of the blocking member 130 to the slider body 110 and the pull tab attachment rod 120 in the present embodiment 4 is coupling portions between the first dovetail groove portion 111*c* and second dovetail groove portions 123*a* of the slider body 110 and the pull tab attachment rod 120 and the blocking member 30, which is fitted into and thus coupled to the first dovetail groove portion 111*c* and the second dovetail groove portions 123*a*, movement thereof in the upward and downward direction and the right and left direction is prevented, and at the same time, due to locking between the locking surfaces of the locking spaces 123*b*, which are formed in a part of the pull tab attachment rod 120, and the locking claws 133*b* of the blocking member 130, movement of the blocking member 130 in the rear direction is also prevented. Accordingly, the blocking member 130 is strongly connected to both of the slider body 110 and the pull tab attachment rod 120, so that, for example, even if a strong force, which can separate the blocking member 130 from the slider body 110 and the pull tab attachment rod 120, is exerted on the pull tab 5, the blocking member 130 is kept immobilized at the fixed position and thus so large deformation is not caused on the pull tab attachment rod 120.

In the foregoing, although exemplary embodiments of the present invention have been described in detail, the invention is not limited to the embodiments. For example, although in the upper blade 11 of the embodiment 4, the bottomed spring insertion hole 111*d* in which one end of the coil spring 140 can be inserted, is provided in the groove bottom surface of the first dovetail groove portion 111*c* formed in the inner wall of the recessed portion 111*b* of the upper surface thereof so that the coil spring 140 is received and held therein, the invention may employ other structures or configurations allowing the coil spring 140 to be positionally fixed.

Also, in the embodiment 1, the right and left blade pieces 33*a*, which are the second mounted portion of the blocking member 30, have the locking claws 33*b*. Meanwhile, in the embodiment 2, the right and left flat plate portions 61*a*, which are the first mounted portion of the blocking member 60, have the locking claws 61*b*. In the embodiments 3 and 4, the locking claws 92*b* and 133*b* are respectively arranged on the second mounted portion of each of the blocking members 90 and 130.

However, the locking claws, which is the retracting movement preventing means according to the present invention, may be formed on at least one of the first and second mounted portion, which are provided on the blocking member, the first mounting portion, which is provided on the upper blade, and the second mounting portion, which is provided on the free end portion of the pull tab attachment rod. Thus, for example, locking claws may be formed on both of the first mounted portion and the second mounted portion provide on the blocking member. In addition, locking claws may be formed on the first mounting portion provided on the upper blade (or the second mounting portion provided on the free end portion of the pull tab attachment rod) and also locking spaces (locking surfaces) in which the locking claws are to be locked may formed in the first mounted portion (or the second mounted portion) provided on the blocking member.

| Description of Reference Numerals | |
|---|---|
| 1, 2, 3, 4 | Pull Tab Post-Attaching Slider (Slider) |
| 5 | Pull Tab |
| 5a | Pull Tab Main Body |
| 5b | Attachment Shaft Portion |
| 10, 40, 70, 110 | Slider Body |
| 11, 41, 71, 111 | Upper Blade |
| 11a, 41a, 73, 111a | Right and Left Flanges |
| 11b, 41b, 111b | Recessed Portion |
| 11c, 41c-41e | First Dovetail Groove Portion |
| 71c, 71d, 111c | First Dovetail Groove Portion |
| 12, 42, 112 | Lower Blade |
| 11d, 41h-41j, 111e | Protrusion Piece Portion |
| 13, 72 | Guide Post |
| 14, 114 | Element Guide Path |
| 20, 50, 80, 120 | Pull Tab Attachment Rod |
| 21, 51, 81, 121 | Fixed End Portion |
| 22, 52, 82, 122 | Extension Portion |
| 23, 53, 83, 123 | Free End Portion |
| 23a, 53b, 83a, 123a | Second Dovetail Groove Portion |
| 23b, 41g, 123b | Locking Space (for Locking Claws) |
| 23c, 53c, 83b, 123c | Ridge Portion |
| 24, 54, 124 | (Pull Tab) Receiving Space |
| 25, 55, 85, 125 | (Pull Tab) Insertion Gap |
| 26, 56 | Locking Member |
| 30, 60, 90, 130 | Blocking Member |
| 31, 131 | (Rectangular) Base Plate Portion |
| 32 | (U-Shaped) Flange-Like Plate Piece |
| 33 | Erected Plate Piece |
| 33a, 63a, 133a | Right and Left Blade Piece |
| 33b, 61b, 92b, 133b | Locking Claw |
| 41f | Cutout Portion |
| 61 | (U-Shaped) Horizontal Base Plate |
| 61a | Right and Left Flat Plate Portion |
| 91 | Block-Like Body |
| 92 | (T Cross-Sectioned) Erected Portion |
| 92a | Upper Flat Plate Portion |
| 93 | Fitting Portion |
| 111d | Spring Insertion Hole |
| 140 | Coil Spring |
| 141 | (Pull Tab) Passage Space |

The invention claimed is:

1. A pull tab post-attaching slider for a slide fastener, in which: a slider body having upper and lower blades is formed integrally with a pull tab attachment rod for holding a pull tab, in cantilever fashion on an upper surface of the upper blade; the pull tab attachment rod comprises a fixed end portion erected from the upper blade and a free end portion such that an insertion gap through which a part of the pull tab can be inserted is formed between the free end portion and the upper blade; and a blocking member for closing the insertion gap is arranged on the slider body, wherein the upper blade of the slider body comprises a first mounting portion for mounting the blocking member, wherein the free end portion of the pull tab attachment rod comprises a second mounting portion for mounting the blocking member, wherein the blocking member comprises a first mounted portion to be mounted on the first mounting portion of the upper blade and a second mounted portion to be mounted on the second mounting portion of the free end portion, wherein one of the first mounting portion and the first mounted portion comprises a first dovetail groove portion and the other comprises a first fitting engagement portion having a first fitting engagement structure fitted into and engaged with the first dovetail groove portion, and wherein one of the second mounting portion and the second mounted portion comprises a second dovetail groove portion and the other comprises a second fitting engagement portion having a second fitting engagement structure fitted into and engaged with the second dovetail groove portion.

2. The pull tab post-attaching slider according to claim 1, wherein at least one of the first fitting engagement structure and the second fitting engagement structure comprises a retracting movement preventing means for preventing the blocking member from being moved in a retracting direction, and wherein the retracting movement preventing means comprises locking by a locking claw via an elastic member.

3. The pull tab post-attaching slider according to claim 1, wherein the first dovetail groove portion is arranged in the first mounting portion of the upper blade, and wherein the second dovetail groove portion is arranged in the second mounting portion of the free end portion.

4. The pull tab post-attaching slider according to claim 3, wherein the first dovetail groove portion comprises a first recessed groove provided in a peripheral wall of a recessed portion which is provided to be recessed downward from the upper surface of the upper blade, to be recessed at least outward in a slider width direction and having upper and lower inside wall surfaces and a groove bottom surface, and wherein the upper inside wall surface of the first recessed groove is comprised of a protruding piece portion protruding from a position of the groove bottom surface of the first recessed groove toward the recessed portion.

5. The pull tab post-attaching slider according to claim 3, wherein the second dovetail groove portion comprises a pair of second recessed grooves provided to be recessed from right and left side surfaces of the free end portion, which are oriented in a slider width direction, inward in the slider width direction and each having upper and lower inside wall surfaces and a groove bottom surface, and wherein the lower inside wall surface of each of the second recessed grooves is comprised of a ridge portion protruding from a position of the groove bottom surface of each of the second recessed grooves outward in the slider width direction.

6. The pull tab post-attaching slider according to claim 5, wherein the blocking member comprises a base plate portion, a pair of erected plate pieces erected upward from the base plate portion with a predetermined distance therebetween in the slider width direction, and right and left blades extending from upper end portions of the erected plate pieces in directions approaching to each other; and wherein the right and left blades are fitted into and engaged with the pair of the second recessed grooves of the second dovetail groove portion to serve as the second mounted portions.

7. The pull tab post-attaching slider according to claim 6, wherein the blocking member comprises a pair of flat plate piece portions extending from the base plate portion outward in the slider width direction and fitted into and engaged with the first recessed groove of the first dovetail groove portion to serve as the first mounted portion, wherein the recessed portion and the first recessed groove of the first dovetail groove portion form an opening on a rear mouth-side end portion of the upper blade, and wherein the base plate portion and the pair of flat plate piece portions of the blocking member are inserted into the recessed portion and the first recessed groove of the first dovetail groove portion through the opening.

8. The pull tab post-attaching slider according to claim 7, wherein the blocking member comprises a pair of locking claws protruding from the pair of flat plate piece portions outward in the slider width direction, and wherein locking spaces for receiving therein and locking thereto the locking claws are arranged at a shoulder mouths side with respect to the first recessed groove of the first dovetail groove portion in a slider longitudinal direction.

9. The pull tab post-attaching slider according to claim 6, wherein the pull tab attachment rod comprises an extension portion arranged between the fixed end portion and the free end portion, wherein a pull tab receiving portion is arranged between the extension portion and the upper surface of the upper blade, wherein the blocking member comprises a pair of locking claws protruding from opposing side surfaces of the right and left blades in directions approaching to each other, and wherein locking spaces for receiving therein and locking thereto the locking claws are arranged in end portions of the pair of second recessed grooves of the second dovetail groove portion, at a side of the pull tab receiving space.

10. The pull tab post-attaching slider according to claim 5, wherein the first recessed groove of the first dovetail groove portion or the second recessed grooves of the second dovetail groove portion are arranged to be inclined downward toward a shoulder mouths side in a slider longitudinal direction.

* * * * *

UNITED STATES PATENT AND TRADEMARK OFFICE

CERTIFICATE OF CORRECTION

PATENT NO. : 9,220,323 B2
APPLICATION NO. : 14/442248
DATED : December 29, 2015
INVENTOR(S) : Yoshikazu Hamada et al.

It is certified that error appears in the above-identified patent and that said Letters Patent is hereby corrected as shown below:

In the Specification

In column 1, line 16, “an a” and insert -- a --, therefor.

In column 13, line 62, delete “space” and insert -- space. --, therefor.

Signed and Sealed this
Nineteenth Day of April, 2016

Michelle K. Lee

Michelle K. Lee
*Director of the United States Patent and Trademark Office*